US011715411B1

(12) United States Patent
Zhu et al.

(10) Patent No.: US 11,715,411 B1
(45) Date of Patent: Aug. 1, 2023

(54) LCD DRIVE METHOD, DEVICE AND CONTROLLER BASED ON OUTPUT IMAGE FORMAT CONFIGURATION

(71) Applicant: SHENZHEN KEJINMING ELECTRONIC CO., LTD, Guangdong (CN)

(72) Inventors: Xianxiong Zhu, Guangdong (CN); Chunrong Fan, Guangdong (CN); Degang Lei, Guangdong (CN); Yiwei Zheng, Guangdong (CN)

(73) Assignee: SHENZHEN KEJINMING ELECTRONIC CO., LTD, Shenzhen (CN)

( * ) Notice: Subject to any disclaimer, the term of this patent is extended or adjusted under 35 U.S.C. 154(b) by 0 days.

(21) Appl. No.: 18/177,198

(22) Filed: Mar. 2, 2023

(30) Foreign Application Priority Data

Mar. 9, 2022 (CN) ..... 202210233077.8

(51) Int. Cl.
*G09G 3/36* (2006.01)
*G09G 3/20* (2006.01)
*G09G 3/00* (2006.01)

(52) U.S. Cl.
CPC ..... *G09G 3/2096* (2013.01); *G09G 3/001* (2013.01); *G09G 3/36* (2013.01); *G09G 2310/08* (2013.01); *G09G 2340/08* (2013.01)

(58) Field of Classification Search
CPC ..... G09G 3/2096; G09G 3/001; G09G 3/36; G09G 2310/08; G09G 2340/08; G09G 2310/0235; G09G 3/296
See application file for complete search history.

(56) References Cited

U.S. PATENT DOCUMENTS 7,248,314 B2 * 7/2007 Yun ..... G02F 1/133514 349/108
10,770,009 B2 * 9/2020 Nishiguchi ..... G09G 3/001
(Continued)

FOREIGN PATENT DOCUMENTS

CN 1941058 A 4/2007
CN 101140740 A 3/2008
(Continued)

OTHER PUBLICATIONS

Notice of Allowance of counterpart Chinese Patent Application No. 202210233077.8 dated Nov. 2, 2022.
(Continued)

*Primary Examiner* — Antonio A Caschera

(57) ABSTRACT

The method comprises the following steps, generating and sending an output signal to LCD to drive the LCD according to the input image signal and the output image format configuration indication level signal; the output signal comprises an output control clock signal, an output vertical synchronization signal, an output horizontal synchronization signal, an output data valid signal, a combination of monochrome image data signals output in time division and an indication level indicating the monochrome image data signal; one period of the output vertical synchronization signal synchronously outputs a color period signal, the output vertical synchronization signal indicates that a plurality of different color combinations are output, and the different color combinations are controlled by the output image format configuration indication level signal.

9 Claims, 15 Drawing Sheets

(56) References Cited

U.S. PATENT DOCUMENTS

| | | | | |
|---|---|---|---|---|
| 10,939,079 | B2 * | 3/2021 | Miura | G03B 21/2033 |
| 2003/0231191 | A1 | 12/2003 | Glen | |
| 2005/0285834 | A1 | 12/2005 | Nakata | |
| 2006/0181490 | A1 | 8/2006 | Ozaki | |
| 2009/0290075 | A1 | 11/2009 | Sagawa | |
| 2010/0295842 | A1 | 11/2010 | Kota et al. | |
| 2012/0007900 | A1 | 1/2012 | Murai et al. | |

FOREIGN PATENT DOCUMENTS

| | | | |
|---|---|---|---|
| CN | 101707053 | A | 5/2010 |
| CN | 102157137 | A | 8/2011 |
| CN | 102347010 | A | 2/2012 |
| CN | 102356425 | A | 2/2012 |
| CN | 103345908 | A | 10/2013 |
| CN | 106847209 | A | 6/2017 |
| JP | 2000165576 | A | 6/2000 |
| JP | 2000214829 | A | 8/2000 |
| JP | 2001042285 | A | 2/2001 |
| JP | 2002032048 | A | 1/2002 |
| JP | 2005142928 | A | 6/2005 |
| JP | 2009282321 | A | 12/2009 |
| KR | 1020050051077 | A | 6/2005 |
| TW | 200845771 | A | 11/2008 |
| TW | 201021007 | A | 6/2010 |

OTHER PUBLICATIONS

2nd Office Action of counterpart Chinese Patent Application No. 202210233077.8 dated Sep. 9, 2022.

* cited by examiner

LCD DRIVE METHOD, DEVICE AND CONTROLLER BASED ON OUTPUT IMAGE FORMAT CONFIGURATION

CROSS REFERENCE TO RELATED APPLICATIONS

The present application claims the benefit of Chinese Patent Application No. 202210233077.8 filed on Mar. 9, 2022, the contents of which are incorporated herein by reference in their entirety.

Technical field

The application relates to the technical field of LCD display, in particular to an LCD drive method, a device and a controller based on output image format configuration.

Background

The inventor found that the traditional LCD driving solution normally requires multiplex drive circuit to drive light paths of different colors. On the one hand, the use of multiplex drive circuit increases cost, and the multiplex drive circuit drives light paths of different colors separately, which increases the cost, and most importantly, the original multiplex drive LCD would create the problem of inconsistent signals. Moreover, the display characteristics of different LCD screens are not necessarily the same, and one single output solution is also prone to poor display effect.

Summary

The application relates to the technical field of LCD drive and projection, and provides an LCD drive method, an LCD drive device, a controller and a storage medium based on output image format configuration, so as to solve the technical problem of asynchronization and the problem that the display characteristics of different screens cannot be selectively corrected.

Provided is an LCD drive method based on output image format configuration, including:

acquiring an input signal, the input signal includes an input image signal and an output image format configuration indication level signal;

generating and sending an output signal to LCD correspondingly to drive the LCD according to the input image signal and the output image format configuration indication level signal; the output signal includes an output control clock signal, an output vertical synchronization signal, an output horizontal synchronization signal, an output data valid signal, a combination of monochrome image data signals output in time division and an indication level indicating the monochrome image data signal;

one period of the output vertical synchronization signal synchronously outputs a color period signal, the output vertical synchronization signal indicates that a plurality of different color combinations are output, and the different color combinations are controlled by the output image format configuration indication level signal; and in each color period signal output, synchronously outputting multiple periods of the output data valid signal, multiple periods of the output horizontal synchronization signal, the corresponding monochrome image data signal and the indication level of the monochrome image data signal.

In an embodiment, when the output image format configuration indication level is the first level, the first combination of monochrome image data signals output in time division is output; the first combination of monochrome image data signals output in time division includes monochrome image data signals corresponding to red frame period, green frame period, blue frame period and white frame period signals.

In combination with the above embodiment, in an embodiment, each of the red frame period, green frame period, blue frame period and white frame period signals accounts for ¼ of one period of an input vertical synchronization signal, and the red frame period, green frame period, blue frame period and white frame period signals are sequentially continuous.

In an embodiment, when the output image format configuration indication level is the second level, the second combination of monochrome image data signals output in time division is output; the second combination of monochrome image data signals output in time division includes monochrome image data signals corresponding to red frame period, green frame period, blue frame period and black frame period signals.

In combination with the above embodiment, in an embodiment, each of the red frame period, green frame period, blue frame period and black frame period signals accounts for ¼ of one period of an input vertical synchronization signal, and the red frame period, green frame period, blue frame period and black frame period signals are sequentially continuous.

In an embodiment, when the output image format configuration indication level is the third level, the third combination of monochrome image data signals output in time division is output; the third combination of monochrome image data signals output in time division includes monochrome image data signals corresponding to black frame period, red frame period, green frame period, blue frame period and white frame period signals.

In combination with the above embodiment, in an embodiment, each of the black frame period, red frame period, green frame period, blue frame period and white frame period signals accounts for ⅕ of one period of an input vertical synchronization signal, and the black frame period, red frame period, green frame period, blue frame period and white frame period signals are sequentially continuous.

In one embodiment, when the output image format configuration indication level is the fourth level, it is an automatic selection mode, based on the monochrome image data signal output in time division under condition of triple frequency output of red, green and blue in time division at power-on, the first combination of monochrome image data signals output in time division, the second combination of monochrome image data signals output in time division and the third combination of monochrome image data signals output in time division, various combinations of monochrome image data signals output in time division are obtained and the results are compared with internally stored image data, and an appropriate combination of monochrome image data signals output in time division is selected.

In combination with the above embodiment, in an embodiment, if the final result determined by the automatic selection mode is one of the first three output modes, it is output according to the corresponding mode. If it is determined to be the output mode of triple frequency of red, green and blue, it will be output in the mode of triple frequency. The monochrome image data signal output in time division under condition of triple frequency output of red, green and blue each account for ⅓ of one period of the input vertical synchronization signal, and the red frame period, green frame period and blue frame period signals are sequentially continuous.

Provided is an LCD drive device based on output image format configuration, including:

an acquisition module, configured for acquiring an input signal, the input signal includes an input image signal and an output image format configuration indication level signal;

a processing module, configured for generating and sending an output signal to LCD correspondingly to drive the LCD according to the input image signal and the output image format configuration indication level signal; the output signal includes an output control clock signal, an output vertical synchronization signal, an output horizontal synchronization signal, an output data valid signal, a combination of monochrome image data signals output in time division and an indication level indicating the monochrome image data signal;

one period of the output vertical synchronization signal synchronously outputs a color period signal, the output vertical synchronization signal indicates that a plurality of different color combinations are output, and the different color combinations are controlled by the output image format configuration indication level signal; and in each color period signal output, synchronously outputting multiple periods of the output data valid signal, multiple periods of the output horizontal synchronization signal, the corresponding monochrome image data signal and the indication level of the monochrome image data signal.

Provided is a controller, used for:

acquiring an input signal, the input signal includes an input image signal and an output image format configuration indication level signal;

generating and sending an output signal to LCD correspondingly according to the input image signal and the output image format configuration indication level signal; the output signal includes an output control clock signal, an output vertical synchronization signal, an output horizontal synchronization signal, an output data valid signal, a combination of monochrome image data signals output in time division and an indication level indicating the monochrome image data signal;

one period of the output vertical synchronization signal synchronously outputs a color period signal, the output vertical synchronization signal indicates that a plurality of different color combinations are output, and the different color combinations are controlled by the output image format configuration indication level signal; and in each color period signal output, synchronously outputting multiple periods of the output data valid signal, multiple periods of the output horizontal synchronization signal, the corresponding monochrome image data signal and the indication level of the monochrome image data signal.

In one embodiment, a computer-readable storage medium is provided, on which a computer program is stored, and when the computer program is executed by the controller, the following steps are realized:

acquiring an input signal, the input signal includes an input image signal and an output image format configuration indication level signal;

generating and sending an output signal to LCD correspondingly to drive the LCD according to the input image signal and the output image format configuration indication level signal; the output signal includes an output control clock signal, an output vertical synchronization signal, an output horizontal synchronization signal, an output data valid signal, a combination of monochrome image data signals output in time division and an indication level indicating the monochrome image data signal;

one period of the output vertical synchronization signal synchronously outputs a color period signal, the output vertical synchronization signal indicates that a plurality of different color combinations are output, and the different color combinations are controlled by the output image format configuration indication level signal; and in each color period signal output, synchronously outputting multiple periods of the output data valid signal, multiple periods of the output horizontal synchronization signal, the corresponding monochrome image data signal and the indication level of the monochrome image data signal.

Compared with the traditional solution, on the one hand, the LCD drive method, LCD drive device, controller and storage medium based on the output image format configuration utilize the regenerated output signal containing time sequence control, can select the desired frequency output and the output of different color combinations according to the indication of the output image format configuration indication level signal, and have diversity to meet more display requirements. Moreover, in the present technical solution, one drive circuit can be used to drive the LCD panel according to the above output signal, which does not require multiple drive circuits to drive images of different light paths respectively and output them, so that the problem of inconsistent signals when loading image data of different colors would not occur due to the delay of signals output by different drive circuits. In addition, because the control timing of the output signal can drive color signals of multiple light paths, it is unnecessary to drive the LCD panel with multiple drive circuits, which is beneficial to reducing cost. In addition, the display characteristics of different LCD screens are not necessarily the same, therefore providing a correction solution with multiple display characteristics can allow users to choose a driving solution more suitable for the display effect of the screen used. With the output signal format configuration indication level, screens with different display characteristics can be configured with different formats and output to correct screen display effect.

BRIEF DESCRIPTION OF DRAWINGS

In order to illustrate the technical solutions in the embodiments of the present application or in the prior art more clearly, the drawings in the description of the embodiments of the present application will be briefly introduced below. It is obvious that the drawings in the following description only show some embodiments of the present application. A person of ordinary skill in the art can obtain other drawings according to these drawings without any creative effort.

DETAILED DESCRIPTION OF DISCLOSED EMBODIMENTS

Figure 1:
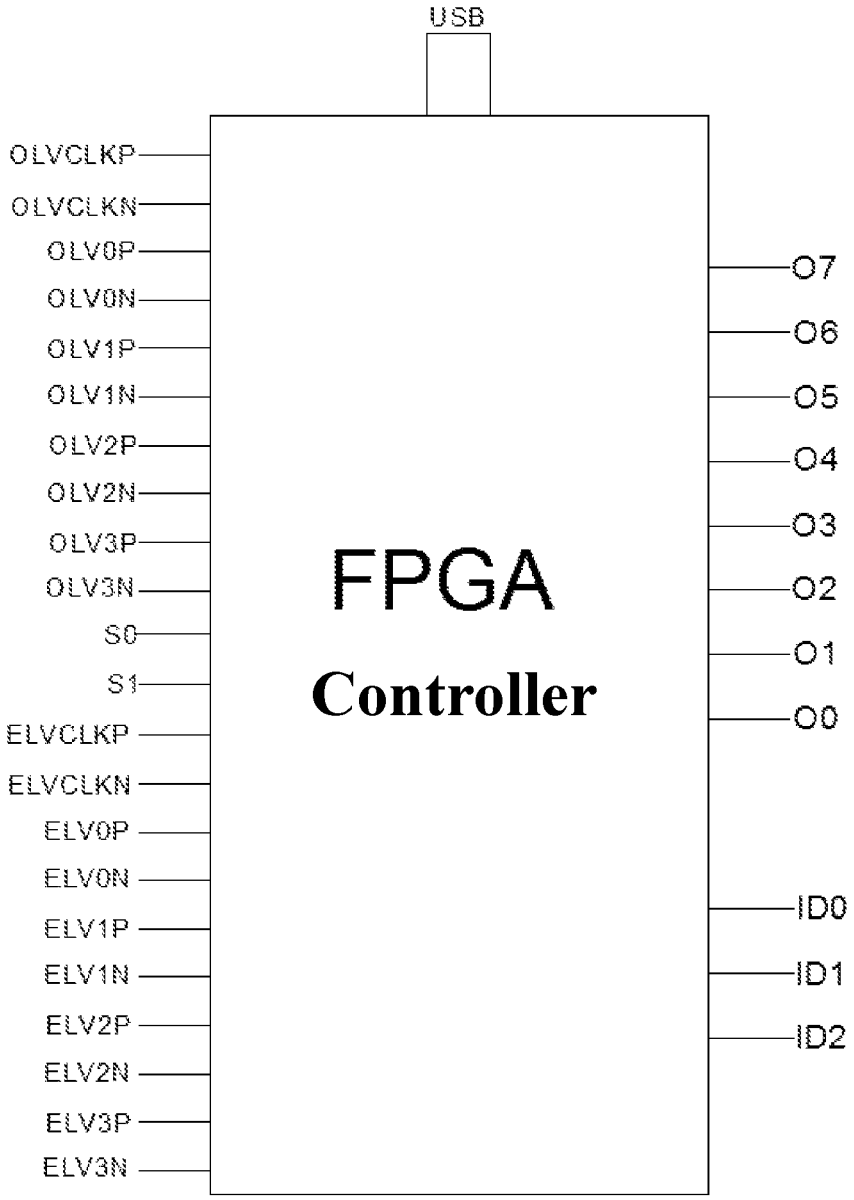
FIG. 1 is a schematic diagram of a pin of a controller according to an embodiment of the present application.

In the following, the technical solutions in the embodiments of the application will be clearly and completely described with reference to the drawings. It is apparent that the described embodiments are some but not all of the embodiments of the present application. All other embodiments obtained by a person of ordinary skill in the art without any creative effort on the basis of the embodiments in the present disclosure shall fall into the scope of the present disclosure.

The LCD drive method based on output image format configuration provided by the present application can be applied to various LCD application scenarios, including, for example, LCD control scenarios of an LCD-based projection device. Taking this application scenario as an example, the LCD-based projection device includes a circuit system for processing image data. After receiving the input image data through a video or an image interface, the circuit system needs to process the input image data correspondingly, split and cache the simultaneously input image data signals to obtain monochrome image data signals, and then transmit the processed monochrome image data signals to the LCD panel driver and project them through the projection lens. The circuit system includes a controller, an image or a video interface, and some buffer memories that can split the image signal into monochrome image signals, which are not detailed here. Exemplarily, the controller may be an FPGA controller, as shown in FIG. 1, or other types of controllers, which is not limited specifically.

To understand this, the process of projection imaging is briefly introduced. It can be understood that the continuous image corresponding to the content to be projected consists of a plurality of continuous one-frame images, while one-frame image is divided into multiple lines of images, and depending on the resolution, one line includes multiple pixels, i.e., one-frame image is a pixel matrix. In the process of projection display, the display decomposes a frame of image into lines, and then divides the lines into pixels. The circuit system will drive the liquid crystal molecules of the corresponding LCD pixels to change according to the data to be projected, so that the values of the corresponding monochrome image data signals will change, and the colors corresponding to the display data will be generated and projected by optical system. However, in the traditional solution, for each monochromatic light, it is necessary to configure a corresponding drive circuit, which on the one hand increases the circuit cost. And on the other hand, because multiple drive circuits control different light paths, it is prone to delay and inconsistent signals, which leads to poor LCD driving effect. Moreover, the existing solution is relatively simplistic, merely relying on the output of red, green and blue monochromatic lights, without taking the influence of current surrounding environment into consideration, which may eventually lead to inappropriate projection imaging quality. It can be seen that an LCD drive method based on output image format configuration is urgently needed to improve the LCD effect, whether in LCD projection scenario or other scenarios using LCD.

To understand the present application, firstly, the terminology used in the present application and the controller using the LCD drive method based on output image format configuration shall be described.

Please refer to FIG. 1, which is a schematic diagram of a pin of a controller according to the present invention. In this embodiment, as an example, the controller is an FGPA (Field Programmable Gate Array) controller. The controller includes a plurality of input pins, a plurality of output pins and a USB interface, wherein the input pins are used for acquiring input signals, the output pins are used to output signals. The input signals include input control clock signal (CLK), input image signal and output image format configuration indication level signal (S0-S1). The input image signal may have various forms of input image signals, including TTL signal, LVDS signal, MIPI signal and etc.

In this example, dual LVDS signals are used for illustration. In an embodiment, the controller may be configured with an input interface, which may be a USB interface, and the USB interface is used for connecting a camera in USB format to take pictures for comparison with internal image data. In this embodiment, the USB interface may be connected to a camera, and the FPGA controller is used to read the LCD driving display effect picture shot by the camera from the memory through the USB interface, compare with the internal image data, and then select (automatic selection mode) the output signal mode of automatic configuration for subsequent output signal control.

Figure 2:
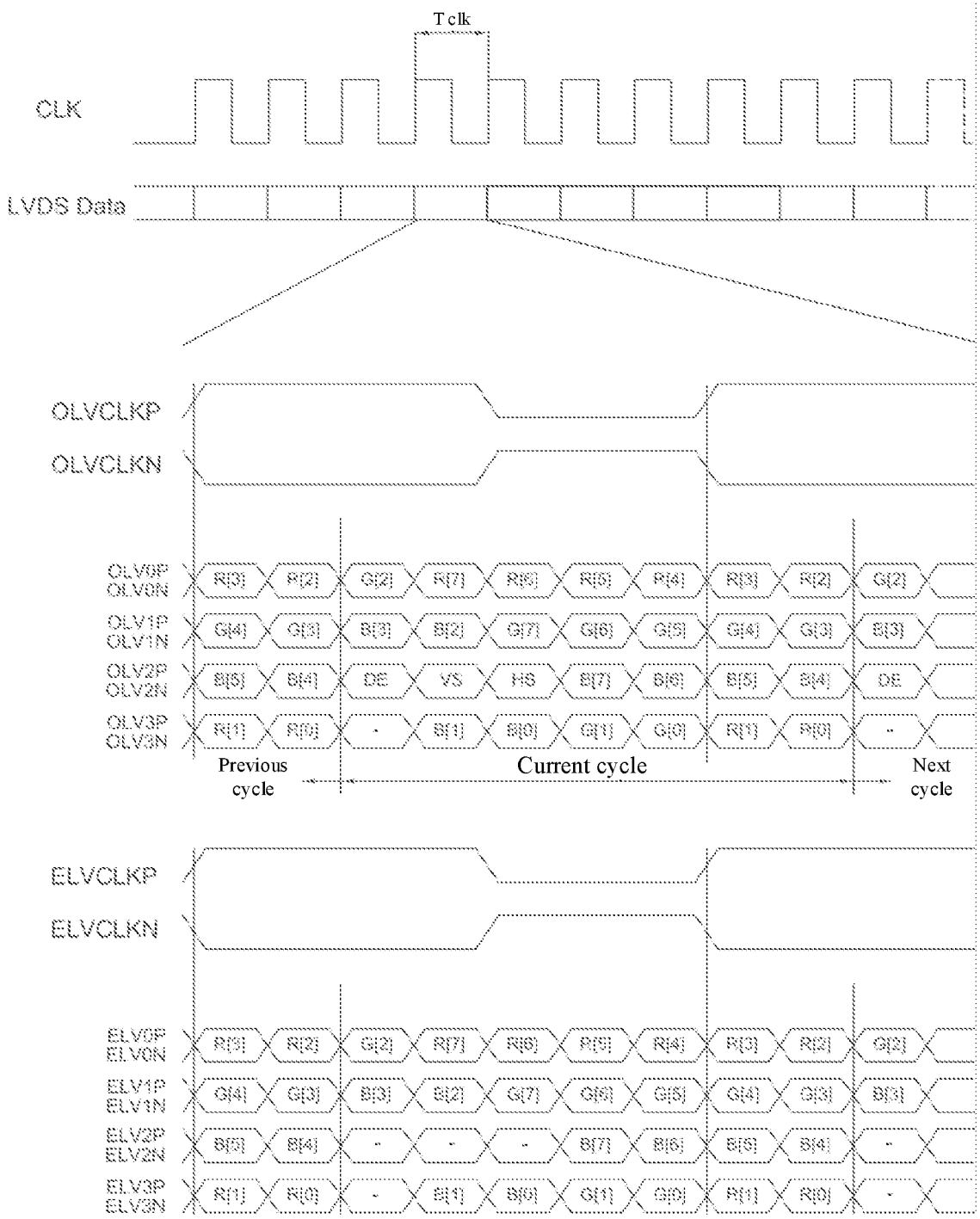
FIG. 2 is a schematic diagram of a timing relationship of an LVDS input image signal according to an embodiment of the present application.

As shown in FIG. 2, an LVDS input image signal is synchronously input under the control of an input control clock signal (CLK), and a T_clk is a period of the input control clock signal. The LVDS input image signal (LVDS Data) includes a first differential clock pair signal (OLVCLKP, OLVCLKN) and a second differential clock pair signal (ELVCLKP, ELVCLKN), and input image data (OLV0P-OLV3P, OLV0N-OLV3N) controlled by first differential clock pair signal (OLVCLKP, OLVCLKN) and input image data (ELV0P-ELV3P, ELV0N-ELV3N) controlled by second differential clock pair signals (ELVCLKP, ELVCLKN).

Figure 3:
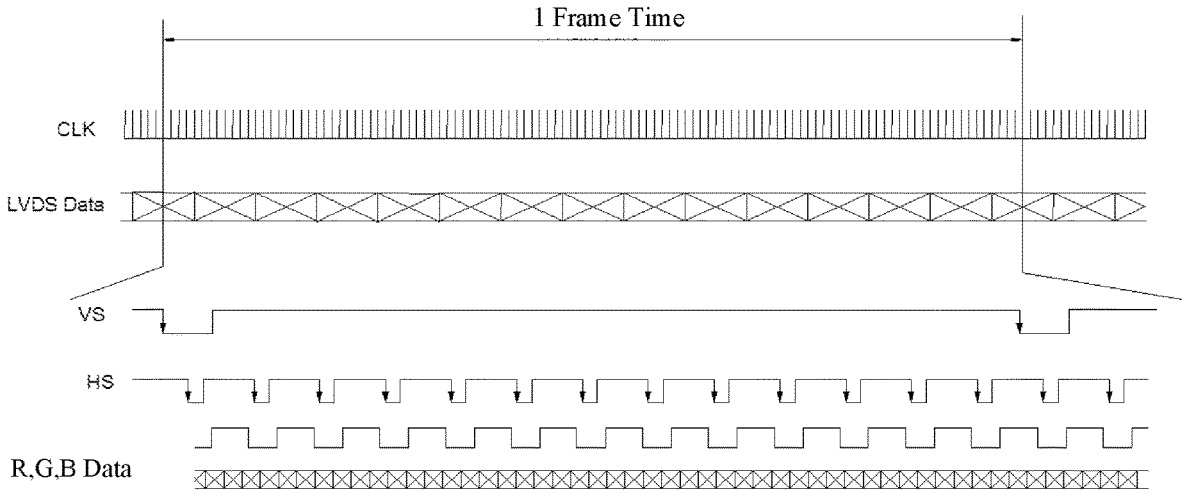
FIG. 3 is a schematic diagram of relationship showing an LVDS input image signal being decoded and translated into RGB format according to an embodiment of the present application.

It can be understood that both LVDS input image signal and RGB input image signal are a kind of input image signal. And it is more convenient to describe the LVDS signal by decoding and translating it into TTL signal, as shown in FIG. 3, which is a schematic diagram of relationship showing an LVDS input image signal being decoded and translated into RGB format. It should be noted that in this embodiment, for the convenience of explaining the relationship between the input signal and output signal, the timing relationship between the input signal and output signal will be explained by taking the decoding and translation of the LVDS input image signal into RGB signals (Vs signal, Hs signal, etc.) as an example, but in this embodiment, the input image signal input to the PPGA controller may be an LVDS input image signal.

To facilitate the understanding of the present application, the input signal, output signal and other terms involved in the present application will be described as follows:

1 Frame Time: one frame input image period;

CLK signal: input control clock signal;

DE signal: effective signal of image data after being translated into RGB format;

Hs signal: image horizontal synchronization signal after being translated into RGB format;

Hsync: initial signal interval of each periodic signal in the HS signal, indicating the beginning of a line of the input image;

HBP (Horizontal Back Porch): back porch of each period in Hs signal, Hs3, Hs4 or Hs5 signals;

HFP (Horizontal Front Porch): front porch of each period in Hs signal, Hs3, Hs4 or Hs5 signals;

Vs signal: vertical synchronization signal;

Vsync: initial signal interval of each periodic signal in Vs signal, indicating the beginning of a frame of the input image;

VBP (Vertical Back Porch): back porch of each period in Vs signal, Vs3, Vs4 or Vs5 signals;

VFP (Vertical Front Porch): front porch of each period in VS signal, Vs3, Vs4 or Vs5 signals;

Valid Date Interval: valid data interval of the input image;

R, G and B data: red, blue and green data signals in RGB input image signals;

PLCK3 signal: triple output control clock signal;

PLCK4 signal: quadruple output control clock signal;

PLCK5 signal: quintuple output control clock signal;

DE3 signal: triple output data valid signal;

DE4 signal: quadruple output data valid signal;

DE5 signal: quintuple output data valid signal;

Hs3 signal: triple output horizontal synchronization signal;

Hs4 signal: quadruple output horizontal synchronization signal;

Hs5 signal: quintuple output horizontal synchronization signal;

Vs3 signal: triple output vertical synchronization signal;

Vs4 signal: quadruple output vertical synchronization signal;

Vs5 signal: quintuple output vertical synchronization signal;

Valid Date Interval: valid data interval of the output monochrome image data signal;

00-07: representing 8 bits of an output monochrome image data signal in the output image signal output in time division;

S1, S0: representing the output image format configuration indication level signal; where: 00 is the first indication level; 01 is the second indication level; 10 is the third indication level; 11 is the fourth indication level (automatic selection mode). That is, the output image format configuration indication level signals S1-S0 are the indication levels used to configure the output format, and the above specific level combination is only an example and can be freely combined;

ID0, ID1, D2: representing indication level of monochrome image data signals output in time division; where: 000 indicates the output black data signal; 111 indicates the output white data signal; 001 indicates the output red data signal; 010 indicates the output green data signal; 011 indicates the output blue data signal. That is, indication level of monochrome image data signals output in time division (ID0-D2) is the level used to configure the output monochrome frame. The above level combination is only an example and can be freely combined, this is taken as an example for illustration.

In an embodiment, an LCD drive method based on output image format configuration is provided, including the following steps:

acquiring an input signal, the input signal includes an input image signal and an output image format configuration indication level signal (S0-S1);

In an embodiment, taking the input image signal as an LVDS input image signal as an example. For convenience of explanation, the LVDS input image signal is decoded and translated into an input vertical synchronization signal Vs, an input horizontal synchronization signal Hs and an input data valid signal DE. The input image signal includes a red data signal R, a green data signal G and a blue data signal B of all pixels of each frame image. The corresponding timing relationship is shown in FIG. 3.

generating and sending an output signal to LCD correspondingly to drive the LCD according to the input image signal and the output image format configuration indication level signal; the output signal includes an output control clock signal, an output vertical synchronization signal, an output horizontal synchronization signal, an output data valid signal, a monochrome image data signal output in time division 00-07 and an indication level indicating the monochrome image data signal ID0-ID2;

One period of the output vertical synchronization signal synchronously outputs a color period signal, the output vertical synchronization signal indicates that a plurality of different color combinations are output, and the different color combinations are controlled by the output image format configuration indication level signal; and in each color period signal output, synchronously outputting multiple periods of the output data valid signal, multiple periods of the output horizontal synchronization signal, the corresponding monochrome image data signal and the indication level of the monochrome image data signal.

It can be seen that, compared with the traditional solution, on the one hand, the LCD drive method, LCD drive device, controller and storage medium based on the output image format configuration utilize the regenerated output signal containing time sequence control, can select the desired frequency output and the output of different color combinations according to the indication of the output image format configuration indication level signal, and have diversity to meet more display requirements. Moreover, in the present technical solution, one drive circuit can be used to drive the LCD panel according to the above output signal, which does not require multiple drive circuits to drive images of different light paths respectively and output them, so that the problem of inconsistent signals when loading image data of different colors would not occur due to the delay of signals output by different drive circuits. In addition, because the control timing of the output signal can drive color signals of multiple light paths, it is unnecessary to drive the LCD panel with multiple drive circuits, which is beneficial to reducing cost.

In this embodiment, according to a variety of different color combinations, controlled by the output image format configuration indication level signal, the monochrome image data signal output in time division may be able to be achieve triple frequency output, quadruple frequency output and quintuple frequency output. The quadruple frequency output has two situations, and in order to distinguish the output control clock signal, output vertical synchronization signal, output horizontal synchronization signal, output data valid signal and other signals in these situations, different frequency outputs are distinguished by frequency multiplication. For example, in the case of triple frequency output, the output vertical synchronization signal is called triple frequency output vertical synchronization signal (Vs3), in the case of quadruple frequency output, the output vertical synchronization signal is called quadruple frequency output vertical synchronization signal (Vs4), in the case of triple frequency output, the output horizontal synchronization signal is called triple frequency output horizontal synchronization signal (Hs3), and so on.

In addition, for convenience of description, when the output image format configuration indication level signal is the first level, the case of quadruple output (including white frames) is called first combination of monochrome image data signals output in time division; when the output image format configuration indication level signal is the second level, another case of quadruple output (including black frames) is called second combination of monochrome image data signals output in time division; when the output image format configuration indication level signal is the third level, the case of quintuple output is called third combination of monochrome image data signals output in time; when the output image format configuration indication level is the fourth level, it is an automatic selection mode, which is called the fourth combination of monochrome image data signals output in time division.

It should be noted that the fourth combination of monochrome image data signals output in time division is an automatic selection mode. In this mode, the best output image data format combination will be selected according to the monochrome image data signal output in time division under condition that triple frequency is output in time division at power-on, and the first, second and third image data output in time division. And various output image data will be obtained through USB and compared with the internally stored image data. That is, according to the monochrome image data signal output in time division under condition that triple frequency is output in time division at power-on, the first combination of monochrome image data signals output in time division, the second combination of monochrome image data signals output in time division and the third combination of monochrome image data signals output in time division, various combinations of monochrome image data signals output in time division are obtained and the results are compared with internally stored image data, and an appropriate combination of monochrome image data signals output in time division is selected.

In this embodiment, based on the input signal, in a preset time period, according to the output image format configuration indication level signal, if it is the fourth level (automatic selection mode), the first combination of monochrome image data signals output in time division, the second combination of monochrome image data signals output in time division, the third combination of monochrome image data signals output in time division, and the monochrome image data signal output in time division under condition that triple frequency is output in time division at power-on will be output respectively. That is, triple frequency, quadruple frequency and quintuple frequency are respectively output, and then the respective LCD driving display effects can be obtained through an external camera, and the optimal output in time division can be automatically selected according to these LCD driving effects, and the final combination mode of monochrome image data signals output in time division can be determined according to the respective LCD driving display effects images of various output monochrome image data signal combinations (that is, the optimal combination of monochrome image data signals output in time division can be automatically selected from the four kinds of frequency output modes mentioned above). For example, when it is determined to use the third combination of monochrome image data signals output in time division (i.e., quintuple output), the combination of monochrome image data signals output in time division is the indications of black frame signal, red frame signal, green frame signal, blue frame signal and white frame signal.

Of course, in some embodiments, it may be in response to user input to select an appropriate combination mode of monochrome image data signals output in time division, which is not limited in the present application. That is, it includes the solution of automatic selection of output in time division. Or it may be selected in response to users, which is flexible and diverse. Similarly, when the USB camera comparison function is removed, the fourth output mode may be changed to triple frequency output, or the automatic selection mode of the fourth level output may be cancelled directly. These simple choices also apply to this embodiment.

The frequency multiplication output modes mentioned above will be described below.

First case, a case of quadruple output.

Figure 4:
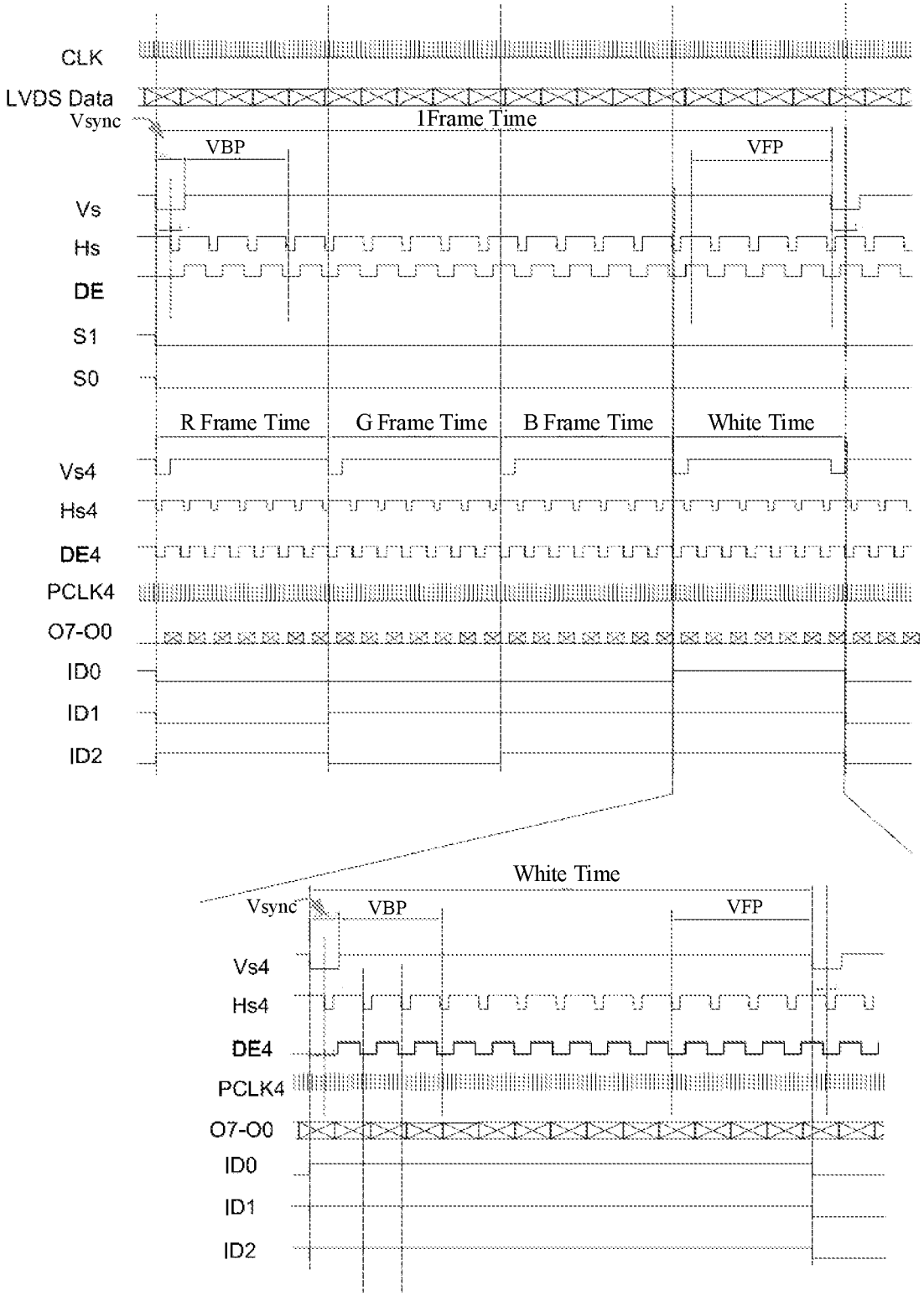
FIG. 4-6 is a schematic diagram of the time sequence relationship of the quadruple output signal generated and output in response to the output image format configuration indication level signal according to an embodiment of the present application.
Figure 5:
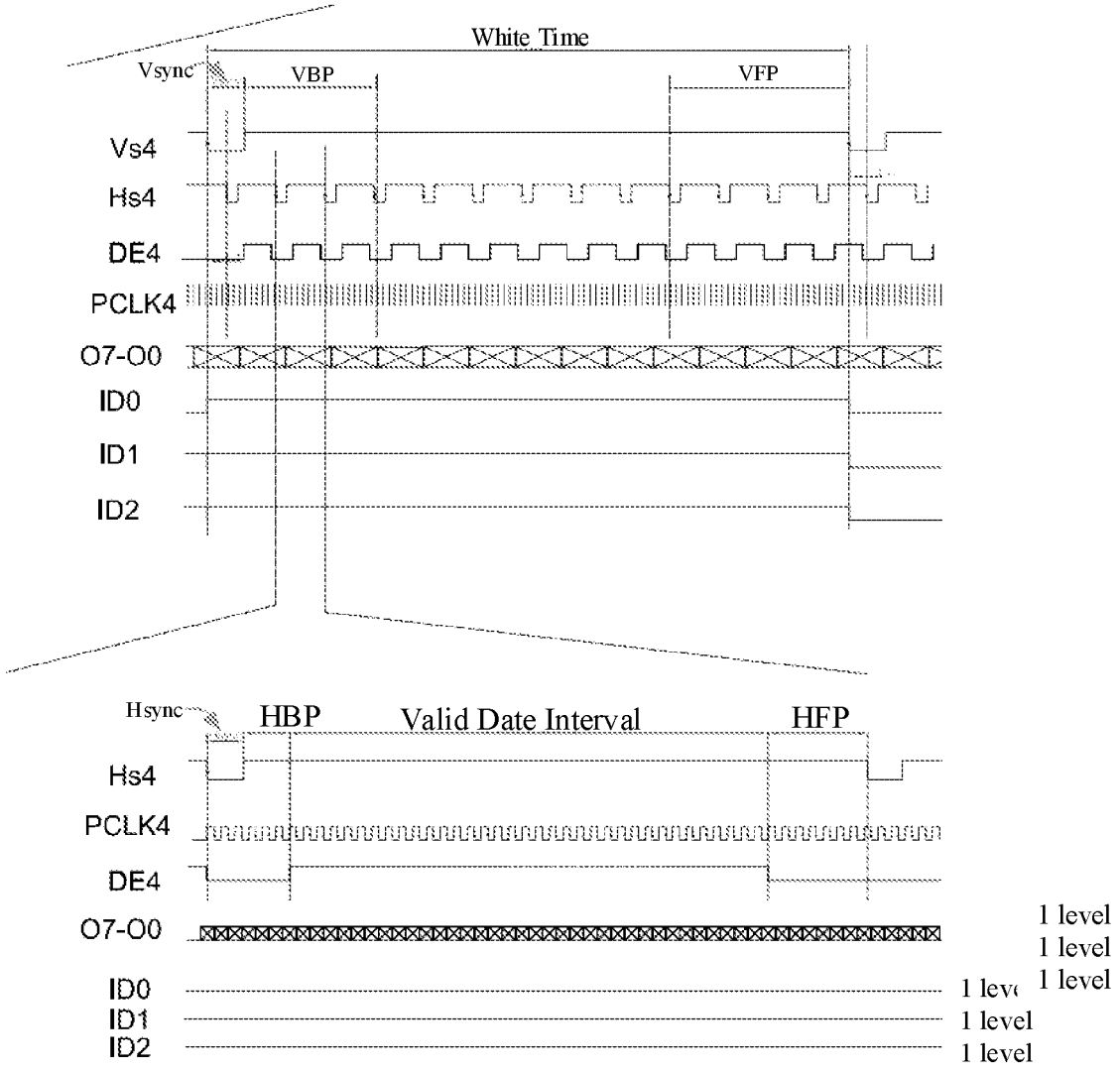
Figure 6:
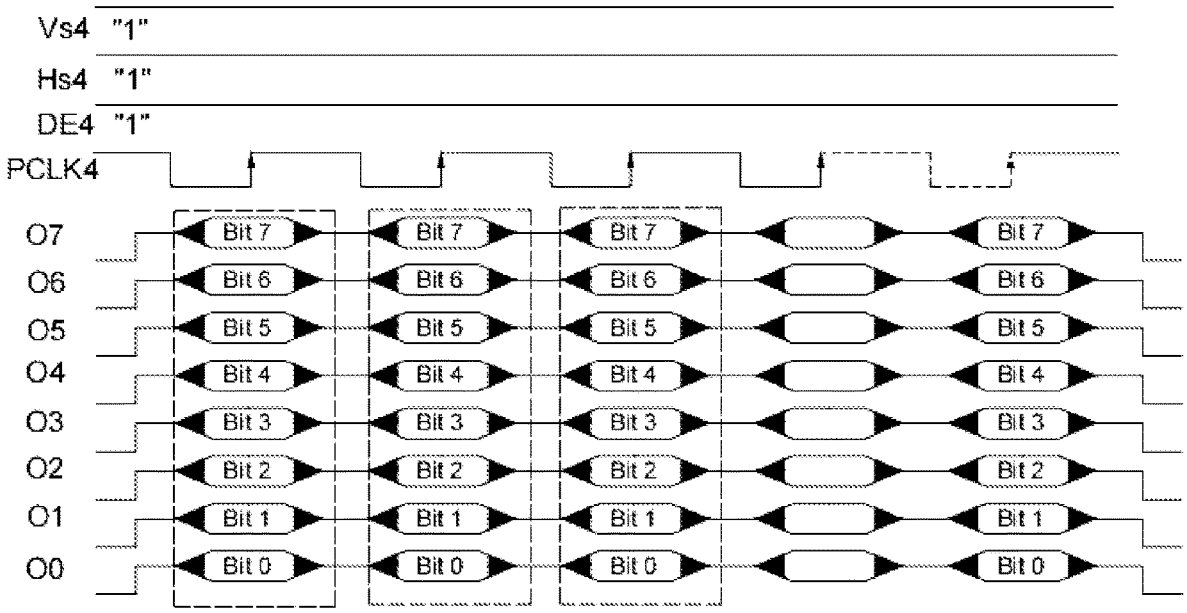

As shown in FIGS. 4-6, in an embodiment, when the output image format configuration indication level signal (S0-S1) is the first level (00), the first combination of monochrome image data signals output in time division is output. The first combination of monochrome image data signals output in time division includes monochrome image data signals corresponding to red frame period, green frame period, blue frame period and white frame period signals.

In combination with the above embodiment, in a specific embodiment, each of the red frame period, green frame period, blue frame period and white frame period signals accounts for ¼ of one period of an input vertical synchronization signal, thus realizing quadruple output, and the red frame period, green frame period, blue frame period and white frame period signals are sequentially continuous.

In this embodiment, as shown in FIGS. 4-6, schematic diagrams of the time sequence relationship between the input signal and output signal. One period of the quadruple output vertical synchronization signal (Vs4) indicates that a color periodic signal is synchronously output. The quadruple output vertical synchronization signal (Vs4) includes a red frame period (R Frame Time), a green frame period (G Frame Time), a blue frame period (B Frame Time) and a white Time period (W Frame Time). In each output color period, a plurality of periodic signals of the quadruple output data valid signal (DE4), a plurality of periodic signals of the quadruple output horizontal synchronization signal (Hs4), the corresponding monochrome image data signals (00-07) output in time division and the corresponding indication levels (ID0-ID2) of the monochrome image data signals (00-07) are synchronously output.

In the quadruple output data valid signal DE4 (level 1) of the red frame period (R Frame Time), under the control of the quadruple output control clock PCLK4, all lines of red data signals corresponding to the output red frame period (R Frame Time) and red period indication level (001) are controlled. Each quadruple output horizontal synchronization signal (Hs4) in the red frame period (R Frame Time) is used for controlling the start of outputting one line of red data signals, and the red period indication level is used to indicate the output of red output image signal.

In the quadruple output data valid signal DE4 (level 1) of the green frame period (G Frame Time), under the control of the quadruple output control clock PCLK4, all lines of green data signals corresponding to the output green frame period (G Frame Time) and green period indication level (010) are controlled. Each quadruple output horizontal synchronization signal (Hs4) in the green frame period (G Frame Time)

is used for controlling the start of outputting one line of green data signals, and the green period indication level is used to indicate the output of green output image signal.

In the quadruple output data valid signal DE4 (level 1) of the blue frame period (B Frame Time), under the control of the quadruple output control clock PCLK4, all lines of blue data signals corresponding to the output blue frame period (B Frame Time) and blue period indication level (011) are controlled. Each quadruple output horizontal synchronization signal (Hs4) in the blue frame period (B Frame Time) is used for controlling the start of outputting one line of blue data signals, and the blue period indication level is used to indicate the output of blue output image signal.

In the quadruple output data valid signal DE4 (level 1) of the white frame period (W Frame Time), under the control of the quadruple output control clock PCLK4, all lines of white data signals corresponding to the output white frame period (W Frame Time) and white period indication level (111) are controlled. Each quadruple output horizontal synchronization signal (Hs4) in the white frame period (W Frame Time) is used for controlling the start of outputting one line of white data signals, and the white period indication level is used to indicate the output of white output image signal.

It should be noted that in this embodiment, by adding white frame, the brightness can be improved under the condition of reducing cost. It simply needs to configure according to demand or automatically control the output image format configuration indication level according to the display effect.

To understand the embodiment of the present application, the embodiment of the present application will be described in detail with reference to FIGS. 4-6. Please refer to FIG. 4, which is a schematic diagram of the control timing of input signals in the present application. The control timing diagram shown in FIG. 2 is related to the timing of input signals, and the controller is used to acquire input signals. The input signals include input control clock signal CLK, LVDS input image signal LVDS Data and output image format configuration indication level signal (S0-S1). Here, FIG. 3 is a schematic diagram of decoding LVDS input image signals into Vs, DE, Hs and other signals for convenience of explanation.

Please refer to FIG. 4, in the time sequence of one frame of input image period, the frame of input image period synchronically corresponds to the time sequence diagram of an input horizontal synchronization signal (Hs) obtained after conversion. Each period signal of the complete input vertical synchronization signal (Vs) represents one frame of input image period. Here, taking one frame of input image period as an example. Each period signal of the vertical synchronization signal Vs will synchronously correspond to multiple period signals of the horizontal synchronization signal (Hs), and each period signal of the horizontal synchronization signal (Hs) will also correspond to a line of timing chart.

The timing diagram of image data is received during the LVDS data valid signal DE is 1, and when the data valid signal DE is 1, the input image data is received. An input control clock signal period receives the input image signal of one pixel. The period during which horizontal line synchronization signal Hs changes from 0 to 1 until the data valid signal DE changes to 1 is the front porch (HBP) of the current cycle of the horizontal synchronization signal (Hs). When the horizontal synchronization signal (Hs) is 1 and the data valid signal DE is also 1, a line of RGB data corresponding to the current display frame in the image signal will be synchronously received. For example, this line of RGB data includes N pixels, and a group of RGB data (R1\G1\B1) of one pixel is output by each input control clock signal period, then this line of data includes pixels (Pixel1, Pixel2, Pixel3, . . . , Pixeln). Each pixel includes its own 8-bit R\G\B data. Take Pixel1 as an example, including R1\G1\B1. R1\G1\B1 all include 8-bit data, and are respectively represented by Bit0~Bit7. This R1\G1\B1 constitutes the color value of Pixel1. Take Pixel2 as an example, including R2\G2\B2. R2\G2\B2 all include 8-bit data, and are also respectively represented by Bit0~Bit7. This R2\G2\B2 constitutes the color value of Pixel2. Take Pixel3 as an example, including R3\G3\B3. R3\G3\B3 all include 8-bit data, and are respectively represented by Bit0~Bit7. This R3\G3\B3 constitutes the color value of Pixel3. Take Pixeln as an example, including Rn\Gn\Bn. Rn\Gn\Bn all include 8-bit data, and are respectively represented by Bit0~Bit7. This Rn\Gn\Bn constitutes the color value of Pixeln. And so on, and no more examples here.

On the other hand, please continue to refer to FIG. 5, when the data valid signal DE changes from 1 to 0 after receiving a line of input image signals, stop receiving the input image signals and wait for the arrival of the horizontal synchronization signal (Hs) of the next cycle. The period from the time when the data valid signal DE changes from 1 to 0 to the time when the line synchronization signal Hs changes from 1 to 0 is the back porch (HFP) of the horizontal synchronization signal Hs in the current cycle. The back porch (HFP) of the horizontal synchronization signal (Hs) passing through the current cycle is the horizontal synchronization signal (Hs) of the next cycle. In the timing diagram of the whole input signal, the time sequence of the whole input signal is calculated in the smallest unit of CLK signal, and Hsync+HBP+Valid Date Interval+HFP is one period of the input horizontal synchronization signal (Hs). A vertical synchronization signal (Vs) includes multiple periodic signals of the horizontal synchronization signal (Hs), and one vertical synchronization signal (Vs) will receive one complete frame of input image signal synchronously.

By analogy, in the period of the next horizontal synchronization signal (Hs), the input image signal of the next line would also be received, so that the input image signal of a complete frame would be received. Similarly, by the next frame, i.e., 2 Frame Time, according to the received input signal, the input image signal of one line can be received in sequence, and the input image signal of one frame will be received over time. That is, the input image signal includes red data signals, green data signals and blue data signals of all pixels of each frame image.

In the embodiment of the application, different from the traditional solution, the output signal is generated and output by a controller based on the input image signal and the new drive method according to the time sequence of the input signal.

According to the time sequence of the received input signals, the output signal is correspondingly generated and sent to the LCD. The output signal includes a quadruple output control clock signal PCLK4, a quadruple output vertical synchronization signal (Vs4), a quadruple output horizontal synchronization signal (Hs4), a quadruple output data valid signal (DE4), four kinds of monochrome image data signals (00-07) output in time division, and corresponding indication levels of the four kinds of monochrome image data signals (ID0-ID2). ID0-ID2 represent the indication level of monochrome image data signal, and 00-07 represent the 8-bit data of the output red data signal, output green data signal, output blue data signal or output white data signal at different frames of each pixel, which are used for loading to the LCD panel.

Referring to FIG. 4, a quadruple output vertical synchronization signal (Vs4) is generated and output within one frame of input image period, which is synchronized with the input vertical synchronization signal (Vs). The quadruple output vertical synchronization signal (Vs4) is divided into different color periods, and one period of the quadruple output vertical synchronization signal (Vs4) represents a color period signal, including a red frame period (R Frame Time), a green frame period (G Frame Time), a blue frame period (B Frame Time) and a white frame period (W Frame Time), wherein each of the red frame period, green frame period, blue frame period and white frame period is ¼ of the input vertical synchronization signal (Vs), so as to realize the quadruple output to improve brightness. In each output color period, a plurality of periodic signals of the quadruple output data valid signal (DE4), a plurality of periodic signals of the quadruple output horizontal synchronization signal (Hs4) and an output image signal are synchronously output. In each color period, the plurality of periods of the quadruple output horizontal synchronization signal (Hs4) is synchronously output in red frame period (R Frame Time), the plurality of periods of the quadruple output horizontal synchronization signal (Hs4) is synchronously output in green frame period (G Frame Time), the plurality of periods of the quadruple output horizontal synchronization signal (Hs4) is synchronously output in blue frame period (B Frame Time), and the plurality of periods of the quadruple output horizontal synchronization signal (Hs4) is synchronously output in white frame period (W Frame Time).

Please continue to refer to FIG. 5, taking the white frame period as an example. The white frame period takes up a period of quadruple output vertical synchronization signal (Vs4). One period of quadruple output vertical synchronization signal (Vs4) includes Vsync4 signal period, VBP4 signal period and VFP4 signal period. In this white frame period, the plurality of periods of the quadruple output horizontal synchronization signal (Hs4) will be synchronously output.

The duration of every quadruple output horizontal synchronization signal (Hs4) in the white frame period is configured as Hsync4+Vaild Date Interval4+HFP4.

As shown in FIG. 5, a period of quadruple output horizontal synchronization signal (Hs4) is taken as an example to illustrate the process of outputting white data signals. In the quadruple output horizontal synchronization signal (Hs4), when in the quadruple output data valid signal (DE4 is at high level), when the output data valid signal (DE4) is at high level, it is used to control the output of all lines of white data signals corresponding to the white frame period, and the white period indication levels. When the quadruple output data valid signal (DE4) is at high level, a quadruple output control clock signal (PCLK4) will synchronously output a group of white data signals in one line, and the period of quadruple output data valid signal (DE4) includes multiple periods of quadruple output control clock signal (PCLK4). Therefore, all lines of white data signals in the white data signals of this line are output, so that in the white frame period, the output white data signals are Bit0-bit7, and the white period indication level (ID0-ID2) is output as 111.

By analogy, when the quadruple output vertical synchronization signal (Vs4) is output in the next period, in the red frame period, green frame period, blue frame period and white period of synchronous output, corresponding monochromatic color data signals are also output according to the corresponding quadruple output control clock signal (PCLK4) and quadruple output data valid signal (DE4). Thus, the LCD is driven to render a complete image through the quadruple output vertical synchronization signal (Vs4).

In this way, after the LCD receives the above output signals, images can be loaded and displayed based on the above output signals. When it is applied to LCD projection devices, the driving process of the LCD is similar, which is not repeated here.

Second case, another case of quadruple output.

Figure 7:
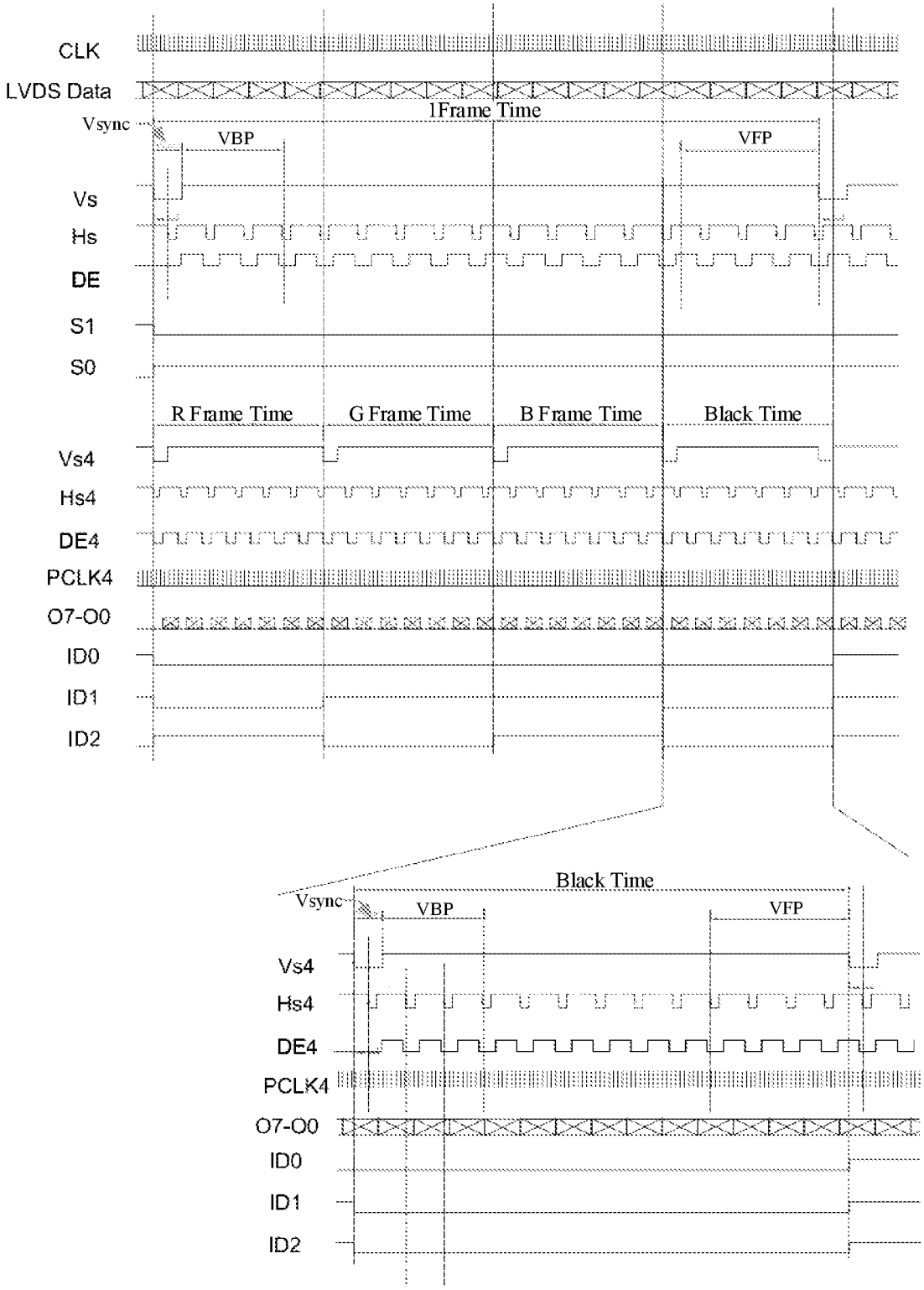
FIG. 7-9 is an another schematic diagram of the time sequence relationship of the quadruple output signal generated and output in response to the output image format configuration indication level signal according to an embodiment of the present application.
Figure 8:
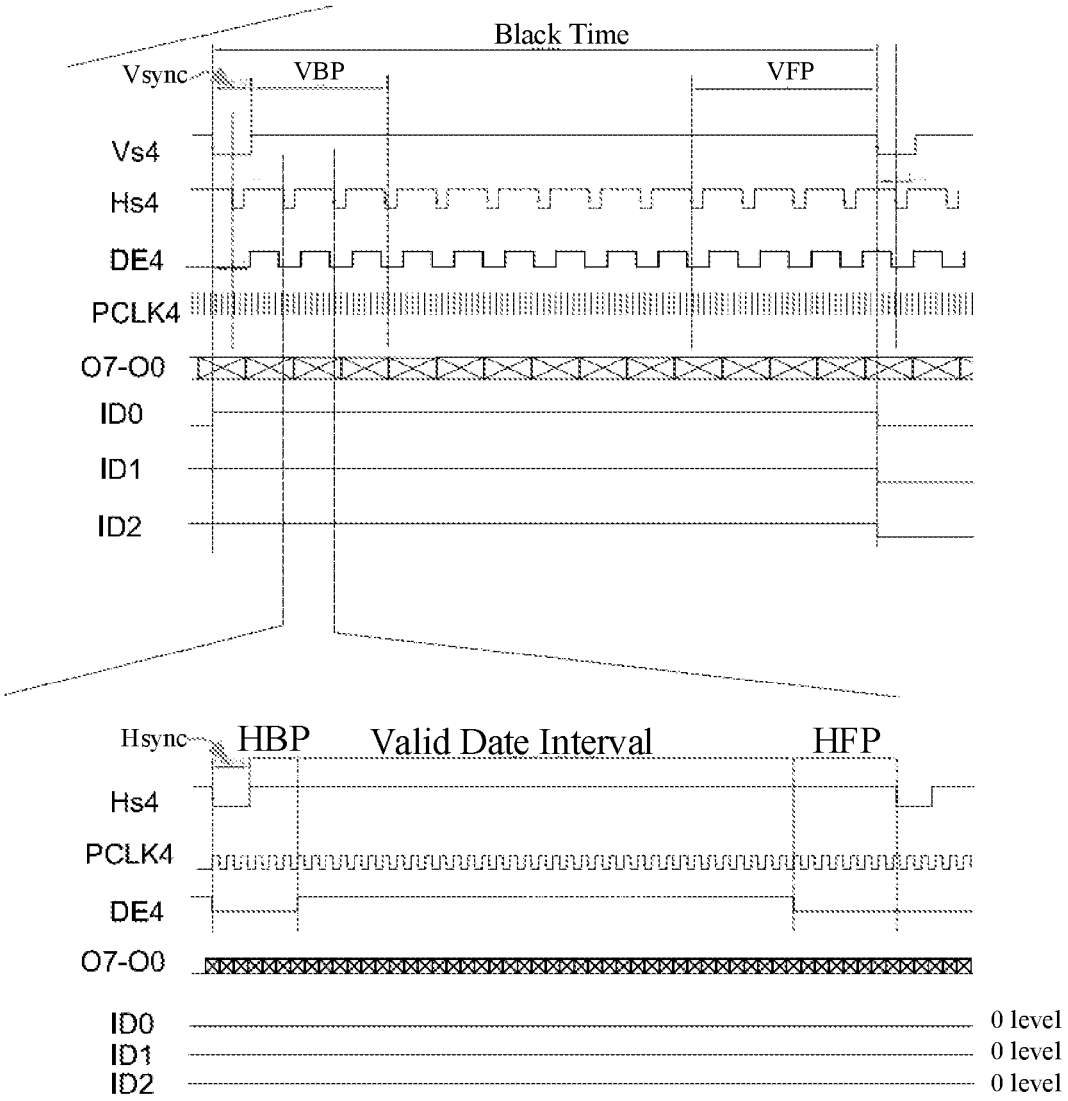
Figure 9:
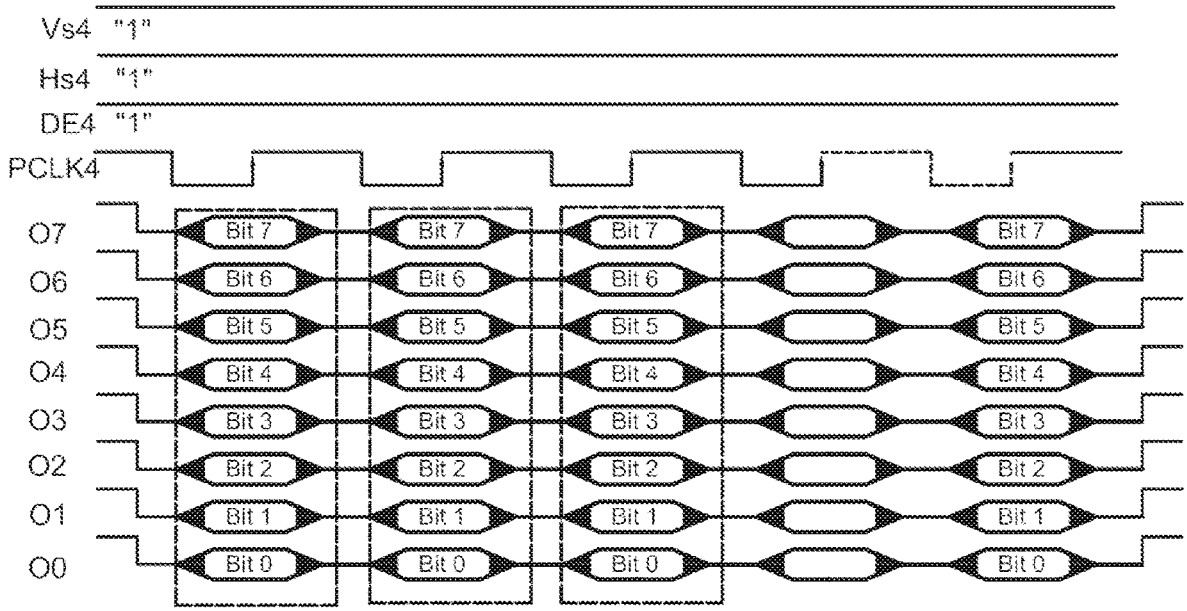

As shown in FIGS. 7-9, in an embodiment, when the output image format configuration indication level signal (S0-S1) is the second level (01), the second combination of monochrome image data signals output in time division is output. The second combination of monochrome image data signals output in time division includes monochrome image data signals corresponding to red frame period, green frame period, blue frame period and black frame period signals.

In combination with the above embodiment, in a specific embodiment, each of the red frame period, green frame period, blue frame period and black frame period signals accounts for ¼ of one period of an input vertical synchronization signal, and the red frame period, green frame period, blue frame period and black frame period signals are sequentially continuous.

In this embodiment, as shown in FIGS. 7-9, a color period signal is synchronously output by one period of the quadruple output vertical synchronization signal (Vs4). The quadruple output vertical synchronization signal (Vs4) includes a red frame period (R Frame Time), green frame period (G Frame Time), blue frame period (B Frame Time) and black frame period (Black Frame Time). In each output color period, a plurality of periodic signals of the quadruple output data valid signal (DE4), a plurality of periodic signals of the quadruple output horizontal synchronization signal (Hs4), the corresponding monochrome image data signals (00-07) output in time division and the corresponding indication levels (ID0-ID2) are synchronously output.

In the quadruple output data valid signal DE4 (level 1) of the red frame period (R Frame Time), under the control of the quadruple output control clock PCLK4, all lines of red data signals corresponding to the output red frame period (R Frame Time) and red period indication level (001) are controlled. Each quadruple output horizontal synchronization signal (Hs4) in the red frame period (R Frame Time) is used for controlling the start of outputting one line of red data signals, and the red period indication level is used to indicate the output of red output image signal.

In the quadruple output data valid signal DE4 (level 1) of the green frame period (G Frame Time), under the control of the quadruple output control clock PCLK4, all lines of green data signals corresponding to the output green frame period (G Frame Time) and green period indication level (010) are controlled. Each quadruple output horizontal synchronization signal (Hs4) in the green frame period (G Frame Time) is used for controlling the start of outputting one line of green data signals, and the green period indication level is used to indicate the output of green output image signal.

In the quadruple output data valid signal DE4 (level 1) of the blue frame period (B Frame Time), under the control of the quadruple output control clock PCLK4, all lines of blue data signals corresponding to the output blue frame period (B Frame Time) and blue period indication level (011) are controlled. Each quadruple output horizontal synchronization signal (Hs4) in the blue frame period (B Frame Time) is used for controlling the start of outputting one line of blue data signals, and the blue period indication level is used to indicate the output of blue output image signal.

In the quadruple output data valid signal DE4 (level 1) of the black frame period (Black Frame Time), under the control of the quadruple output control clock PCLK4, all lines of black data signals corresponding to the output black frame period (Black Frame Time) and black period indication level (000) are controlled. Each quadruple output horizontal synchronization signal (Hs4) in the black frame period (Black Frame Time) is used for controlling the start of outputting one line of black data signals, and the black period indication level is used to indicate the output of black output image signal.

It should be noted that in this embodiment, by adding black frame, the contrast can be adjusted according to demand under the condition of reducing cost. It simply needs to follow the demand or automatically select the output image format configuration indication level.

For other more time series relationships, please refer to the description of the above embodiments and FIGS. 7-9, which are no longer described here.

Third case, a case of quintuple output.

Figure 10:
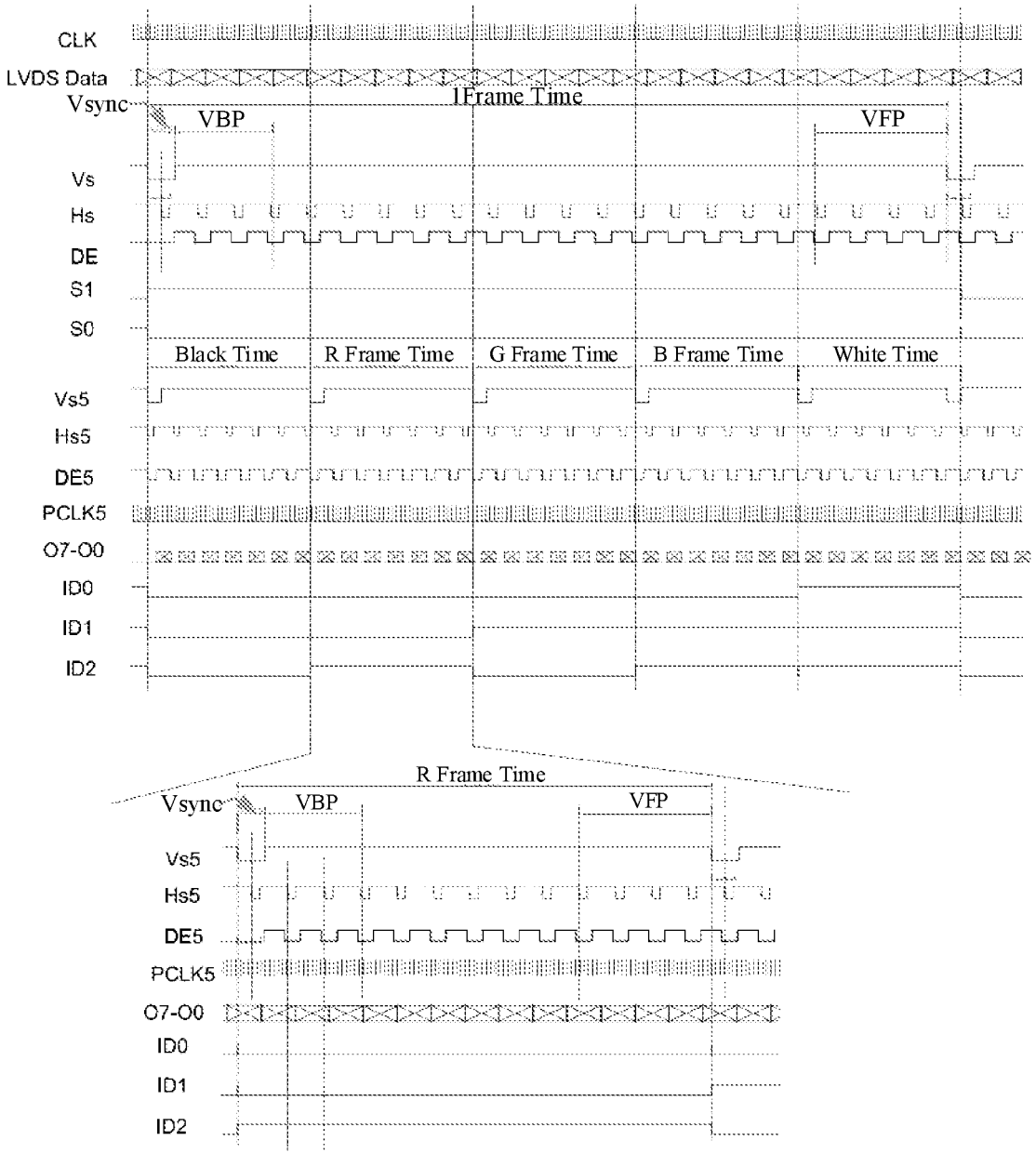
FIG. 10-12 is a schematic diagram of the time sequence relationship of the quintuple output signal generated and output in response to the output image format configuration indication level signal according to an embodiment of the present application.
Figure 11:
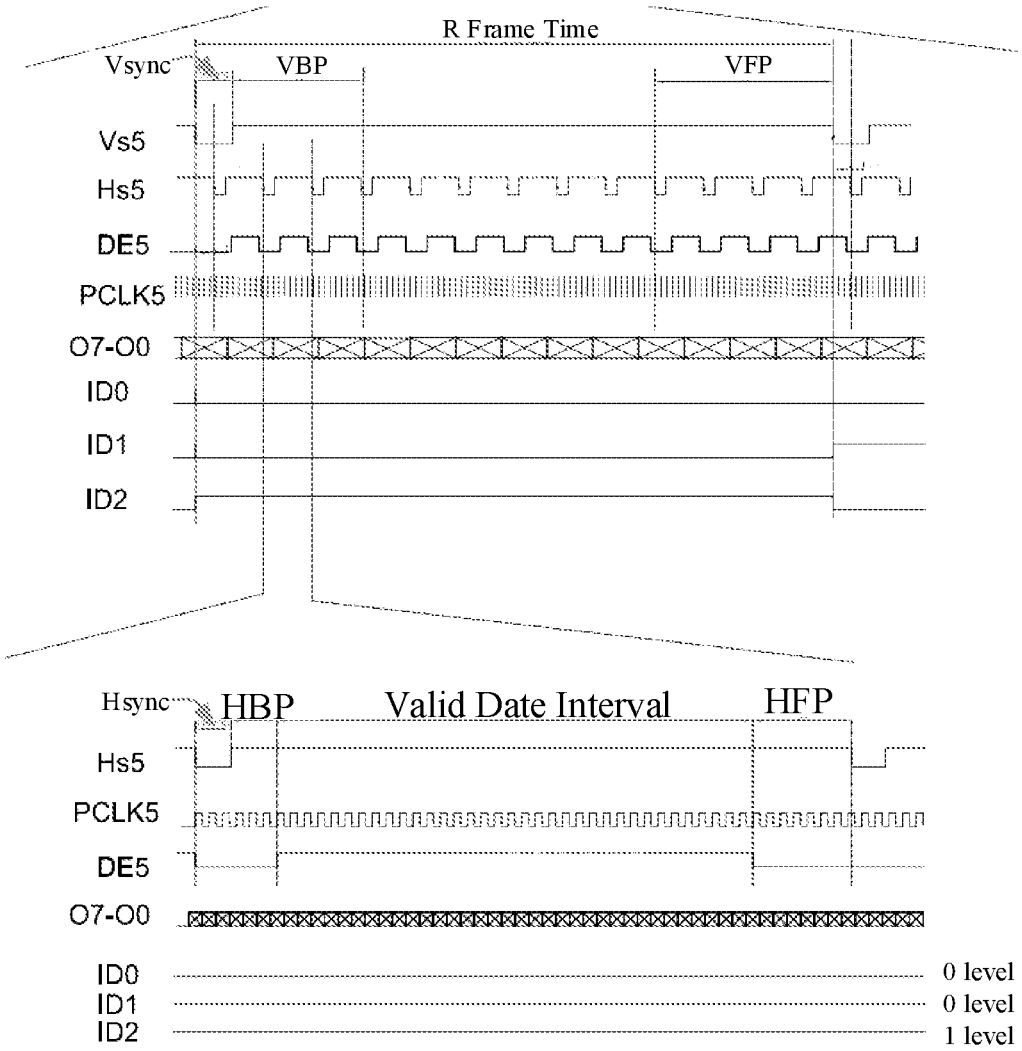
Figure 12:
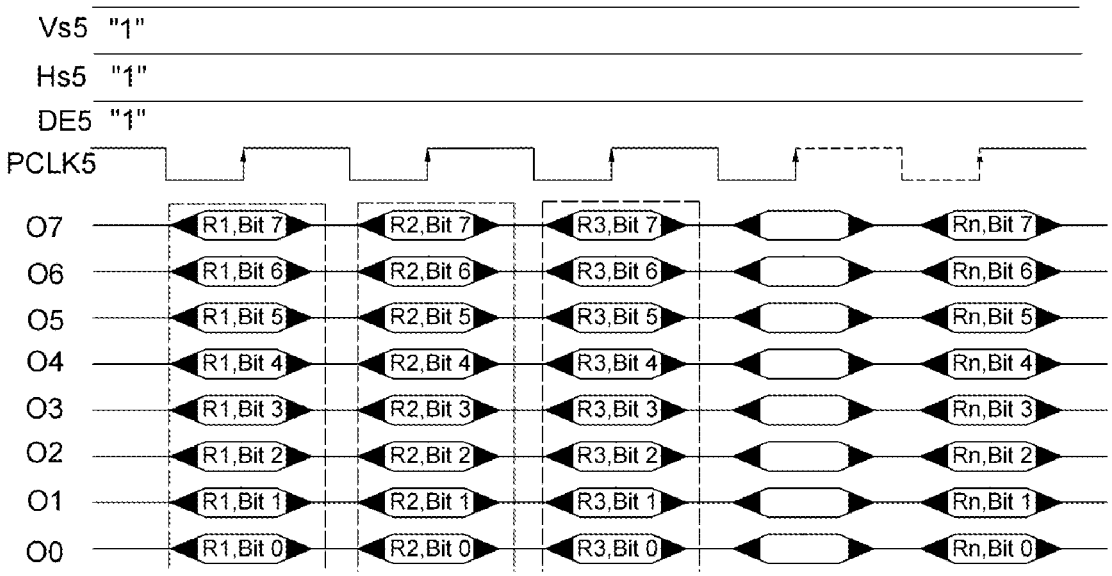

As shown in FIGS. 10-12, when the output image format configuration indication level signal (S0-S1) is the third level (10), the third combination of monochrome image data signals output in time division is output. The second combination of monochrome image data signals output in time division includes monochrome image data signals corresponding to black frame period, red frame period, green frame period, blue frame period and white frame period signals.

In combination with the above embodiment, in an embodiment, each of the black frame period, red frame period, green frame period, blue frame period and white frame period signals accounts for ⅕ of one period of an input vertical synchronization signal, and the black frame period, red frame period, green frame period, blue frame period and white frame period signals are sequentially continuous. In some embodiments, the sequentially continuous signals may be in the order of white frame period, red frame period, green frame period, blue frame period and black frame period, which is not limited here.

In this embodiment, as shown in FIGS. 10-12, a period of the quintuple output vertical synchronization signal (Vs5) represents a color periodic signal. The quintuple output vertical synchronization signal (Vs5) includes a black frame period (Black Frame Time), red frame period (R Frame Time), green frame period (G Frame Time), blue frame period (B Frame Time) and white frame period (White Frame Time). In each output color period, a plurality of periodic signals of the quintuple output data valid signal (DE5), a plurality of periodic signals of the quintuple output horizontal synchronization signal (Hs5), the corresponding monochrome image data signals (00-07) output in time division and the corresponding indication levels (ID0-ID2) are synchronously output.

In the quintuple output data valid signal DE5 (level 1) of the black frame period (Black Frame Time), under the control of the quintuple output control clock PCLKS, all lines of black data signals corresponding to the output black frame period (Black Frame Time) and black period indication level (000) are controlled. Each quintuple output horizontal synchronization signal (Hs5) in the black frame period (Black Frame Time) is used for controlling the start of outputting one line of black data signals, and the black period indication level is used to indicate the output of black output image signal.

In the quintuple output data valid signal DE5 (level 1) of the red frame period (R Frame Time), under the control of the quintuple output control clock PCLKS, all lines of red data signals corresponding to the output red frame period (R Frame Time) and red period indication level (001) are controlled. Each quintuple output horizontal synchronization signal (Hs5) in the red frame period (R Frame Time) is used for controlling the start of outputting one line of red data signals, and the red period indication level is used to indicate the output of red output image signal.

In the quintuple output data valid signal DE5 (level 1) of the green frame period (G Frame Time), under the control of the quintuple output control clock PCLKS, all lines of green data signals corresponding to the output green frame period (G Frame Time) and green period indication level (010) are controlled. Each quintuple output horizontal synchronization signal (Hs5) in the green frame period (G Frame Time) is used for controlling the start of outputting one line of green data signals, and the green period indication level is used to indicate the output of green output image signal.

In the quintuple output data valid signal DE5 (level 1) of the blue frame period (B Frame Time), under the control of the quintuple output control clock PCLK5, all lines of blue data signals corresponding to the output blue frame period (B Frame Time) and blue period indication level (011) are controlled. Each quintuple output horizontal synchronization signal (Hs5) in the blue frame period (B Frame Time) is used for controlling the start of outputting one line of blue data signals, and the blue period indication level is used to indicate the output of blue output image signal.

In the quintuple output data valid signal DE5 (level 1) of the white frame period (W Frame Time), under the control of the quintuple output control clock PCLK5, all lines of white data signals corresponding to the output white frame period (W Frame Time) and white period indication level (111) are controlled. Each quintuple output horizontal synchronization signal (Hs5) in the white frame period (W Frame Time) is used for controlling the start of outputting one line of white data signals, and the white period indication level is used to indicate the output of white output image signal.

For other more time series relationships, please refer to the description of the above embodiments and FIGS. 10-12, which are no longer described here.

Fourth case, automatic selection output mode (suppose the selected output is a case of triple frequency output).

Figure 13:
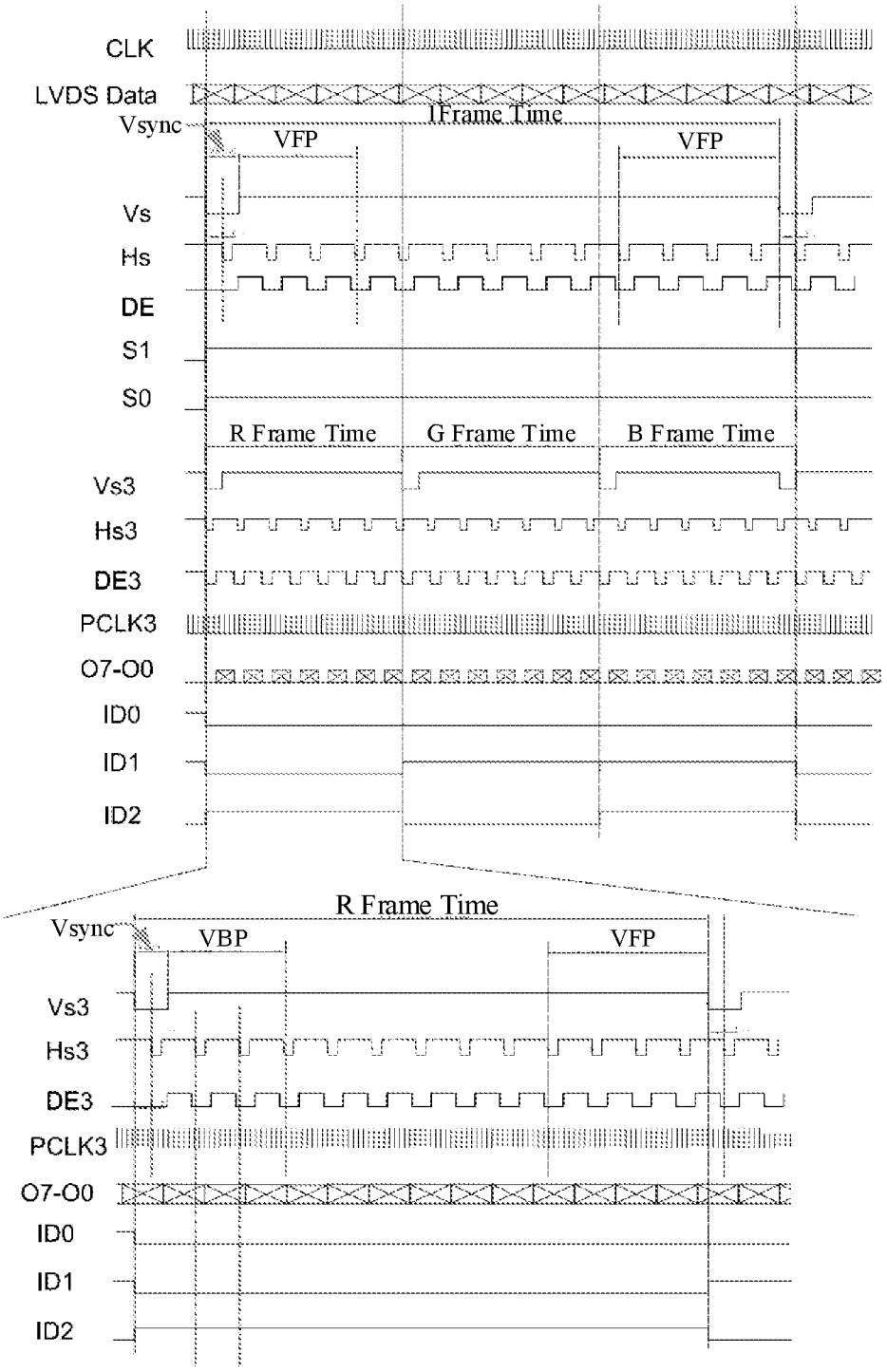
FIG. 13-15 is a schematic diagram of the time sequence relationship according to an embodiment of the present application, showing that: according to the output image format configuration indication level signal, assuming in the automatic mode, triple output is optimal, and the triple output signal is generated and output in response to the triple mode.
Figure 14:
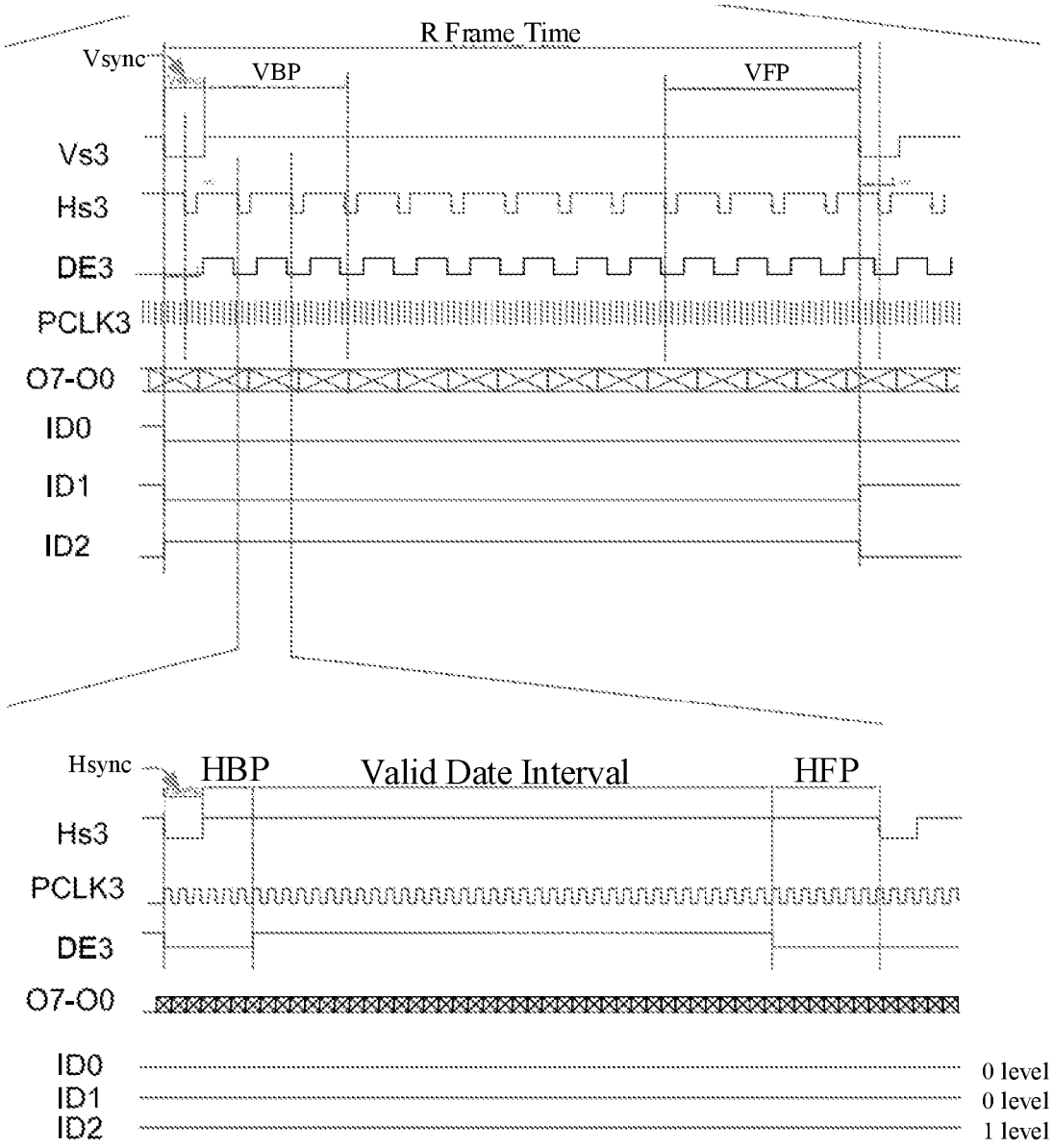
Figure 15:
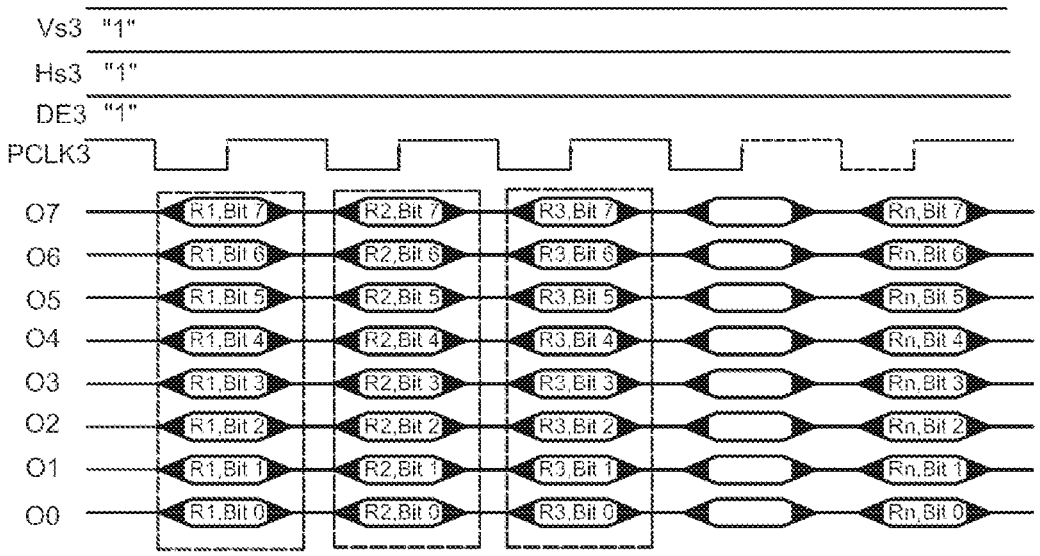

As shown in FIG. 13-15, in an embodiment, when output image format configuration indication level signal (S0-S1) is the fourth level (11), i.e., the automatic selection mode, the fourth combination of monochrome image data signals output in time division will be output. As mentioned above, the fourth combination of monochrome image data signals output in time division is the output case under the automatic selection mode configuration. In this mode, the best output image data format combination will be selected according to the monochrome image data signal output in time division under condition that triple frequency is output in time division at power-on, and the first, second and third image data output in time division. And various output image data will be obtained through USB and compared with the internally stored image data. For the convenience of description, it is assumed that the system selects the first three cases (descriptions are not repeated here). Now, it is assumed that in the automatic selection mode, the monochrome image data signal combination of the triple frequency mode is selected, including the monochrome image data signals corresponding to the red frame period, green frame period and blue frame period signals.

In combination with the above embodiment, in an embodiment, each of the red frame period, green frame period and blue frame period accounts for ⅓ of one period of an input vertical synchronization signal, and the red frame period, green frame period and blue frame period signals are sequentially continuous.

In this embodiment, as shown in FIGS. 13-15, a period of the triple output vertical synchronization signal (Vs3) represents a color periodic signal. The triple output vertical synchronization signal (Vs3) includes a red frame period (R Frame Time), green frame period (G Frame Time) and blue frame period (B Frame Time). In each output color period, a plurality of periodic signals of the triple output data valid signal (DE3), a plurality of periodic signals of the triple output horizontal synchronization signal (Hs3), the corresponding monochrome image data signals (00-07) output in time division and the corresponding indication levels (ID0-ID2) are synchronously output.

In the triple output data valid signal DE3 (level 1) of the red frame period (R Frame Time), under the control of the triple output control clock PCLK3, all lines of red data signals corresponding to the output red frame period (R Frame Time) and red period indication level (001) are controlled. Each triple output horizontal synchronization signal (Hs3) in the red frame period (R Frame Time) is used for controlling the start of outputting one line of red data signals, and the red period indication level is used to indicate the output of red output image signal.

In the triple output data valid signal DE3 (level 1) of the green frame period (G Frame Time), under the control of the triple output control clock PCLK3, all lines of green data signals corresponding to the output green frame period (G Frame Time) and green period indication level (010) are controlled. Each triple output horizontal synchronization signal (Hs3) in the green frame period (G Frame Time) is used for controlling the start of outputting one line of green data signals, and the green period indication level is used to indicate the output of green output image signal.

In the triple output data valid signal DE3 (level 1) of the blue frame period (B Frame Time), under the control of the triple output control clock PCLK3, all lines of blue data signals corresponding to the output blue frame period (B Frame Time) and blue period indication level (011) are controlled. Each triple output horizontal synchronization signal (Hs3) in the blue frame period (B Frame Time) is used for controlling the start of outputting one line of blue data signals, and the blue period indication level is used to indicate the output of blue output image signal.

For other more time series relationships, please refer to the description of the above embodiments and FIGS. 13-15, which are no longer described here.

It can be seen that by adopting the LCD drive method based on output image format configuration provided by the embodiments of the present application, for each monochromatic light, it is not necessary to control the light path of one color by using multiple drive circuits. In this way, on the one hand, the circuit cost will not be increased. On the other hand, instead of controlling different light paths to load different color signals by multiple drive circuits, the controller provides a new monochrome data signal in time division to drive a single LCD display according to the control timing of the output signal uniformly, so the delay problem will not be caused by the differences of circuits and LCD screens, and the driving effect of the LCD will not be deteriorated.

Moreover, the output of triple frequency, quadruple frequency or quintuple frequency may be selected according to the output image format configuration indication level signal, which has diversity and adaptability. When applied to LCD projection devices, the projection imaging quality can be varied, and a more appropriate frequency multiplication output can be automatically selected, which is more adaptable. Furthermore, because the consistency problem is avoided, the projection quality is higher. Thus, it can be seen that it has a good application prospect in both LCD projection scenarios and other scenarios using LCD.

It should be understood that the description of each step in the above embodiments does not imply the order of operation. The order of operation of each process should be determined by its function and internal logic, and shall not constitute any limitations on the operation process of the embodiments of the present application.

In an embodiment, an LCD drive device based on output image format configuration is provided, which corresponds to the LCD drive method based on output image format configuration described in the above embodiments. The LCD drive device based on output image format configuration includes an acquisition module and a processing module. The functional modules are described in detail as follows:

an acquisition module, configured for acquiring an input signal, the input signal includes an input image signal and an output image format configuration indication level signal;

a processing module, configured for generating and sending an output signal to LCD correspondingly to drive the LCD according to the input image signal and the output image format configuration indication level signal; the output signal includes an output control clock signal, an output vertical synchronization signal, an output horizontal synchronization signal, an output data valid signal, a combination of monochrome image data signals output in time division and an indication level indicating the monochrome image data signal;

one period of the output vertical synchronization signal synchronously outputs a color period signal, the output vertical synchronization signal indicates that a plurality of different color combinations are output, and the different color combinations are controlled by the output image format configuration indication level signal; and in each color period signal output, synchronously outputting multiple periods of the output data valid signal, multiple periods of the output horizontal synchronization signal, the corresponding monochrome image data signal and the indication level of the monochrome image data signal.

In an embodiment, outputting the first combination of monochrome image data signals output in time division when the output image format configuration indication level is the first level; the first combination of monochrome image data signals output in time division includes monochrome image data signals corresponding to red frame period, green frame period, blue frame period and white frame period signals; each of the red frame period, green frame period, blue frame period and white frame period signals accounts for ¼ of one period of an input vertical synchronization signal, and the red frame period, green frame period, blue frame period and white frame period signals are sequentially continuous.

In an embodiment, outputting the second combination of monochrome image data signals output in time division when the output image format configuration indication level is the second level; the second combination of monochrome image data signals output in time division includes monochrome image data signals corresponding to red frame period, green frame period, blue frame period and black frame period signals; each of the red frame period, green frame period, blue frame period and black frame period signals accounts for ¼ of one period of an input vertical synchronization signal, and the red frame period, green frame period, blue frame period and black frame period signals are sequentially continuous.

In an embodiment, outputting the third combination of monochrome image data signals output in time division when the output image format configuration indication level is the third level; the third combination of monochrome image data signals output in time division includes monochrome image data signals corresponding to black frame period, red frame period, green frame period, blue frame period and white frame period signals; each of the black frame period, red frame period, green frame period, blue frame period and white frame period signals accounts for ⅕ of one period of an input vertical synchronization signal, and the black frame period, red frame period, green frame period, blue frame period and white frame period signals are sequentially continuous.

In an embodiment, when the output image format configuration indication level is the fourth level, it is an automatic selection mode, based on the monochrome image data signal output in time division under condition of triple frequency output of red, green and blue in time division at power-on, the first combination of monochrome image data signals output in time division, the second combination of monochrome image data signals output in time division and the third combination of monochrome image data signals output in time division, various combinations of monochrome image data signals output in time division are obtained and the results are compared with internally stored image data, and an appropriate combination of monochrome image data signals output in time division is selected.

For the specific definition of the LCD drive device based on output image format configuration, please refer to the definition of the LCD drive method based on output image format configuration above, which will not be repeated here. Each module in the LCD drive device based on output image format configuration can be realized in whole or in part by software, hardware and their combinations. The above modules can be embedded in or separated from the controller in the form of hardware, and can also be stored in the memory of the controller in the form of software, so that the processor can call and execute the operations corresponding to the above modules.

In one embodiment, a controller is provided, which may be an FPGA controller, and when executed, the controller realizes the LCD drive method based on output image format configuration provided in the above embodiments.

In one embodiment, a computer-readable storage medium is provided, on which a computer program is stored, and when the computer program is executed by a controller, the LCD drive method based on output image format configuration provided in the above embodiments is realized.

For more details about the solution executed by the controller and the computer-readable storage medium, please refer to the aforementioned method embodiments, and the descriptions will not be repeated here.

In some embodiments, the embodiment of the present application also provides a projection device, which includes a controller of the present application. Or, the projection device includes a controller and a camera provided by the embodiment of the present application, and the camera is used for shooting LCD driving display effect pictures in various frequency multiplication output modes when in the automatic selection mode. The controller is used to realize the above LCD drive method based on output image format configuration. Please refer to the above descriptions, which are not repeated here. In addition, the output indication levels (ID0-ID2) are also used to control the color of the projection lamp, so that the color output frame matches the corresponding lamp to project and output, which will not be described here.

In addition, the terms "first", "second", "third" and "fourth" in the descriptions of the foregoing embodiments are used to distinguish similar features, not used to describe a specific order or sequence.

A person of ordinary skill in the art can understand that all or part of the processes in the method of the foregoing embodiments can be implemented by instructing related hardware through a computer program, which can be stored in a nonvolatile computer readable storage medium, and the computer program can include the steps of the above embodiments when executed. Wherein, any reference to memory, storage, database or other medium used in the embodiments provided in this application may include nonvolatile and/or volatile memory. The nonvolatile memory may include read-only memory (ROM), programmable ROM (PROM), electrically programmable ROM (EPROM), electrically erasable programmable ROM (EEPROM), or flash memory. The volatile memory may include random access memory (RAM) or external cache memory. As an illustration and not a limitation, RAM is available in many forms, such as static RAM (SRAM), dynamic RAM (DRAM), synchronous DRAM (SDRAM), double data rate SDRAM (DDRSDRAM), enhanced SDRAM (ESDRAM), synchronous link (Synchlink) DRAM (SLDRAM), memory bus, (Rambus), direct RAM (RDRAM), direct memory bus dynamic RAM (DRDRAM), and memory bus dynamic RAM (RDRAM), etc.

A person of ordinary skill in the art can clearly understand that, for the convenience and conciseness of description, the division of the above functional units and modules are only used as examples. In practical applications, the above functions may be implemented by different functional units and modules as needed. That is, the internal structure of the device may divided into different functional units or modules to complete all or part of the functions described above.

The above embodiments are only used to illustrate the technical solutions of the present application, but not to limit it. Although the present application has been described in detail with reference to the foregoing embodiments, those skilled in the art would understand that it is possible to modify the technical solutions described in the foregoing embodiments, or to replace some technical features with equivalents. However, these modifications or substitutions do not make the essence of the corresponding technical solutions deviate from the spirit and scope of the technical solutions of various embodiments of the present application, and shall be included in the protection scope of the present application. Further, unless otherwise required by context, singular terms shall include pluralities and plural terms shall include the singular.

What is claimed is:

1. An LCD drive method based on output image format configuration, used in LCD projection devices, characterized in that the LCD drive method comprises:

acquiring an input signal, the input signal comprises an input image signal and an output image format configuration indication level, and the input signal further comprises an input control clock signal, each input control clock signal period is used for outputting a group of RGB data of a pixel, and one group of RGB data in a line of corresponding color data signal will be synchronously output in each output control clock signal period;

generating and sending an output signal to LCD correspondingly to drive the LCD according to the input image signal and the output image format configuration indication level signal; the output signal comprises an output control clock signal, an output vertical synchronization signal, an output horizontal synchronization signal, an output data valid signal, a combination of monochrome image data signals output in time division and an indication level indicating the monochrome image data signal;

one period of the output vertical synchronization signal synchronously outputs a color period signal, the output vertical synchronization signal indicates that a plurality of different color combinations are output, and the different color combinations are controlled by the output image format configuration indication level signal;

in each color period signal output, synchronously outputting multiple periods of the output data valid signal, multiple periods of the output horizontal synchronization signal, the corresponding monochrome image data signal and the indication level of the monochrome image data signal;

the output image format configuration indication level signal comprises a fourth level signal, and when the output image format configuration indication level signal is the fourth level signal, it is an automatic selection mode, and the combination of monochrome image data signals output in time division comprises: a) a monochrome image data signal output in time division under condition of triple frequency output of red, green and blue in time division at power-on, b) a first combination of monochrome image data signals output in time division, c) a second combination of monochrome image data signals output in time division and d) a third combination of monochrome image data signals output in time division;

acquiring, by an external camera, a plurality of driving effect images output in time division correspondingly when the LCD responds to: a) the monochrome image data signal output in time division under condition of triple frequency output of red, green and blue, b) the first combination of monochrome image data signals output in time division, c) the second combination of monochrome image data signals output in time division and d) the third combination of monochrome image data signals output in time division;

comparing the plurality of driving effect images output in time division with an internally stored image data, and selecting an appropriate combination mode of monochrome image data signals output in time division, so as to drive the LCD according to the appropriate combination mode of monochrome image data signals output in time division; and if the output image format configuration indication level signal is a first level, the first combination of monochrome image data signals output in time division is a case of quadruple output with white frames; if the output image format configuration indication level signal is a second level, the second combination of monochrome image data signals output in time division is a case of quadruple output with black frames; if the output image format configuration indication level signal is a third level, the third combination of monochrome image data signals output in time division is a case of quintuple output.

2. The LCD drive method of claim 1, characterized in that: outputting the first combination of monochrome image data signals output in time division when the output image format configuration indication level signal is the first level signal; the first combination of monochrome image data signals output in time division comprises monochrome image data signals corresponding to red frame period, green frame period, blue frame period and white frame period signals; each of the red frame period, green frame period, blue frame period and white frame period signals accounts for ¼ of one period of an input vertical synchronization signal, and the red frame period, green frame period, blue frame period and white frame period signals are sequentially continuous.

3. The LCD drive method of claim 1, characterized in that: outputting the second combination of monochrome image data signals output in time division when the output image format configuration indication level signal is the second level signal; the second combination of monochrome image data signals output in time division comprises monochrome image data signals corresponding to red frame period, green frame period, blue frame period and black frame period signals; each of the red frame period, green frame period, blue frame period and black frame period signals accounts for ¼ of one period of an input vertical synchronization signal, and the red frame period, green frame period, blue frame period and black frame period signals are sequentially continuous.

4. The LCD drive method of claim 1, characterized in that: outputting the third combination of monochrome image data signals output in time division when the output image format configuration indication level signal is the third level signal; the third combination of monochrome image data signals output in time division comprises monochrome image data signals corresponding to black frame period, red frame period, green frame period, blue frame period and white frame period signals; each of the black frame period, red frame period, green frame period, blue frame period and white frame period signals accounts for ⅕ of one period of an input vertical synchronization signal, and the black frame period, red frame period, green frame period, blue frame period and white frame period signals are sequentially continuous.

5. An LCD drive device based on output image format configuration, used in LCD projection devices, characterized in that the LCD drive device comprises:

an acquisition module, configured for acquiring an input signal, the input signal comprises an input image signal and an output image format configuration indication level, and the input signal further comprises an input control clock signal, each input control clock signal period is used for outputting a group of RGB data of a pixel, and one group of RGB data in a line of corresponding color data signal will be synchronously output in each output control clock signal period;

a processing module, configured for generating and sending an output signal to LCD correspondingly to drive the LCD according to the input image signal and the output image format configuration indication level signal; the output signal comprises an output control clock signal, an output vertical synchronization signal, an output horizontal synchronization signal, an output data valid signal, a combination of monochrome image data signals output in time division and an indication level indicating the monochrome image data signal;

one period of the output vertical synchronization signal synchronously outputs a color period signal, the output vertical synchronization signal indicates that a plurality of different color combinations are output, and the different color combinations are controlled by the output image format configuration indication level signal;

in each color period signal output, synchronously outputting multiple periods of the output data valid signal, multiple periods of the output horizontal synchronization signal, the corresponding monochrome image data signal and the indication level of the monochrome image data signal;

the output image format configuration indication level signal comprises a fourth level signal, and when the output image format configuration indication level signal is the fourth level signal, it is an automatic selection mode, and the combination of monochrome image data signals output in time division comprises: a) a monochrome image data signal output in time division under condition of triple frequency output of red, green and blue in time division at power-on, b) a first combination of monochrome image data signals output in time division, c) a second combination of monochrome image data signals output in time division and d) a third combination of monochrome image data signals output in time division;

acquiring, by an external camera, a plurality of driving effect images output in time division correspondingly when the LCD responds to: a) the monochrome image data signal output in time division under condition of triple frequency output of red, green and blue, b) the first combination of monochrome image data signals output in time division, c) the second combination of monochrome image data signals output in time division and d) the third combination of monochrome image data signals output in time division;

comparing the plurality of driving effect images output in time division with an internally stored image data, and selecting an appropriate combination mode of monochrome image data signals output in time division, so as to drive the LCD according to the appropriate combination mode of monochrome image data signals output in time division; and if the output image format configuration indication level signal is a first level, the first combination of monochrome image data signals output in time division is a case of quadruple output with white frames; if the output image format configuration indication level signal is a second level, the second combination of monochrome image data signals output in time division is a case of quadruple output with black frames; if the output image format configuration indication level signal is a third level, the third combination of monochrome image data signals output in time division is a case of quintuple output.

6. The LCD drive device of claim 5, wherein the processing module is further specifically used for:

outputting the first combination of monochrome image data signals output in time division when the output image format configuration indication level signal is the first level signal; the first combination of monochrome image data signals output in time division comprises monochrome image data signals corresponding to red frame period, green frame period, blue frame period and white frame period signals; each of the red frame period, green frame period, blue frame period and white frame period signals accounts for ¼ of one period of an input vertical synchronization signal, and the red frame period, green frame period, blue frame period and white frame period signals are sequentially continuous.

7. The LCD drive device of claim 5, wherein the processing module is further specifically used for:

outputting the second combination of monochrome image data signals output in time division when the output image format configuration indication level signal is the second level signal; the second combination of monochrome image data signals output in time division comprises monochrome image data signals corresponding to red frame period, green frame period, blue frame period and black frame period signals; each of the red frame period, green frame period, blue frame period and black frame period signals accounts for ¼ of one period of an input vertical synchronization signal, and the red frame period, green frame period, blue frame period and black frame period signals are sequentially continuous.

8. The LCD drive device of claim 5, wherein the processing module is further specifically used for:

when the output image format configuration indication level signal is the third level signal; the third combination of monochrome image data signals output in time division comprises monochrome image data signals corresponding to black frame period, red frame period, green frame period, blue frame period and white frame period signals; each of the black frame period, red frame period, green frame period, blue frame period and white frame period signals accounts for ⅕ of one period of an input vertical synchronization signal, and the black frame period, red frame period, green frame period, blue frame period and white frame period signals are sequentially continuous.

9. A controller, used in LCD projection devices, characterized in that the controller is used for:

acquiring an input signal, the input signal comprises an input image signal and an output image format configuration indication level, and the input signal further comprises an input control clock signal, each input control clock signal period is used for outputting a group of RGB data of a pixel, and one group of RGB data in a line of corresponding color data signal will be synchronously output in each output control clock signal period;

generating and sending an output signal to LCD correspondingly according to the input image signal and the output image format configuration indication level signal; the output signal comprises an output control clock signal, an output vertical synchronization signal, an output horizontal synchronization signal, an output data valid signal, a combination of monochrome image data signals output in time division and an indication level indicating the monochrome image data signal;

one period of the output vertical synchronization signal synchronously outputs a color period signal, the output vertical synchronization signal indicates that a plurality of different color combinations are output, and the different color combinations are controlled by the output image format configuration indication level signal;

in each color period signal output, synchronously outputting multiple periods of the output data valid signal, multiple periods of the output horizontal synchronization signal, the corresponding monochrome image data signal and the indication level of the monochrome image data signal;

the output image format configuration indication level signal comprises a fourth level signal, and when the output image format configuration indication level signal is the fourth level signal, it is an automatic selection mode, and the combination of monochrome image data signals output in time division comprises: a) a monochrome image data signal output in time division under condition of triple frequency output of red, green and blue in time division at power-on, b) a first combination of monochrome image data signals output in time division, c) a second combination of monochrome image data signals output in time division and d) a third combination of monochrome image data signals output in time division;

acquiring, by an external camera, a plurality of driving effect images output in time division correspondingly when the LCD responds to: a) the monochrome image data signal output in time division under condition of triple frequency output of red, green and blue, b) the first combination of monochrome image data signals output in time division, c) the second combination of monochrome image data signals output in time division and d) the third combination of monochrome image data signals output in time division;

comparing the plurality of driving effect images output in time division with an internally stored image data, and selecting an appropriate combination mode of monochrome image data signals output in time division, so as to drive the LCD according to the appropriate combination mode of monochrome image data signals output in time division; and if the output image format configuration indication level signal is a first level, the first combination of monochrome image data signals output in time division is a case of quadruple output with white frames; if the output image format configuration indication level signal is a second level, the second combination of monochrome image data signals output in time division is a case of quadruple output with black frames; if the output image format configuration indication level signal is a third level, the third combination of monochrome image data signals output in time division is a case of quintuple output.

* * * * *